US009654874B2

(12) United States Patent
Park et al.

(10) Patent No.: US 9,654,874 B2
(45) Date of Patent: May 16, 2017

(54) SYSTEMS AND METHODS FOR FEEDBACK DETECTION

(71) Applicant: QUALCOMM Incorporated, San Diego, CA (US)

(72) Inventors: Hyun Jin Park, San Diego, CA (US); Deepak Kumar Challa, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 268 days.

(21) Appl. No.: 14/192,634

(22) Filed: Feb. 27, 2014

(65) Prior Publication Data

US 2015/0172815 A1 Jun. 18, 2015

Related U.S. Application Data

(60) Provisional application No. 61/916,373, filed on Dec. 16, 2013.

(51) Int. Cl.
*G10K 11/16* (2006.01)
*H04R 3/02* (2006.01)
(Continued)

(52) U.S. Cl.
CPC ..... *H04R 3/02* (2013.01); *G10K 11/1788* (2013.01); *H04R 25/453* (2013.01);
(Continued)

(58) Field of Classification Search
CPC ..... G10K 11/1788; G10K 2210/3027; G10K 2210/3026; G10K 11/178;
(Continued)

(56) References Cited

U.S. PATENT DOCUMENTS 6,396,930 B1 5/2002 Vaudrey et al.
6,418,227 B1 * 7/2002 Kuo ..... G10K 11/1788 381/71.1
(Continued)

FOREIGN PATENT DOCUMENTS

EP 0364037 B1 3/1994
GB 2401744 A 11/2004

OTHER PUBLICATIONS

Nakagawa C.R.C., et al., "Dual microphone solution for acoustic feedback cancellation for assistive listening," IEEE International Conference on Acoustics, Speech and Signal Processing (ICASSP), 2012, pp. 149-152.
(Continued)

*Primary Examiner* — Vivian Chin
*Assistant Examiner* — Ubachukwu Odunukwe
(74) *Attorney, Agent, or Firm* — Austin Rapp & Hardman

(57) ABSTRACT

A method for feedback detection by an electronic device is described. The method includes receiving a first microphone signal by a first microphone. A feedback loop includes the first microphone and a speaker. The method also includes receiving a second microphone signal by a second microphone that is outside of the feedback loop. A first signal based on the first microphone signal and a second signal based on the second microphone signal exhibit a higher correlation in presence of feedback and exhibit a lower correlation in absence of feedback. The method further includes determining a correlation based on the first microphone signal and the second microphone signal. The method additionally includes determining whether feedback is occurring based on the correlation.

24 Claims, 13 Drawing Sheets

(51) Int. Cl.
*G10K 11/178* (2006.01)
*H04R 25/00* (2006.01)

(52) U.S. Cl.
CPC ..... *G10K 2210/3026* (2013.01); *G10K 2210/3027* (2013.01); *G10K 2210/3056* (2013.01); *H04R 2460/01* (2013.01)

(58) Field of Classification Search
CPC ..... G10K 2210/3056; G10K 11/1784; H04R 3/02; H04R 2460/01; H04R 25/453
USPC ..... 381/60, 93, 71.11, 71.1, 71.5, 318, 317, 381/56, 110, 74, 71.6, 71.8

See application file for complete search history.

(56) References Cited

U.S. PATENT DOCUMENTS

| | | | | |
|---|---|---|---|---|
| 8,355,517 | B1 | 1/2013 | Fretz | |
| 2002/0176594 | A1 | 11/2002 | Hohmann et al. | |
| 2005/0047620 | A1* | 3/2005 | Fretz | H04R 25/453 381/318 |
| 2006/0210091 | A1 | 9/2006 | Okumura | |
| 2009/0010456 | A1* | 1/2009 | Goldstein | H04R 25/02 381/110 |
| 2011/0235813 | A1* | 9/2011 | Gauger, Jr. | G10L 21/02 381/57 |
| 2014/0126734 | A1* | 5/2014 | Gauger, Jr. | H04R 3/002 381/71.6 |

OTHER PUBLICATIONS

International Search Report and Written Opinion—PCT/US2014/069561—ISA/EPO—Jun. 5, 2015.

* cited by examiner

SYSTEMS AND METHODS FOR FEEDBACK DETECTION

RELATED APPLICATIONS

This application is related to and claims priority to U.S. Provisional Patent Application Ser. No. 61/916,373 filed Dec. 16, 2013, for "SYSTEMS AND METHODS FOR FEEDBACK DETECTION."

TECHNICAL FIELD

The present disclosure relates generally to electronic devices. More specifically, the present disclosure relates to systems and methods for feedback detection.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform new functions and/or that perform functions faster, more efficiently or with higher quality are often sought after.

Some electronic devices (e.g., cellular phones, smartphones, audio recorders, camcorders, computers, etc.) utilize audio signals. These electronic devices may encode, store and/or transmit the audio signals. For example, a smartphone may obtain, encode and transmit a speech signal for a phone call, while another smartphone may receive and decode the speech signal.

However, particular challenges may arise for electronic devices that utilize audio signals. For example, feedback may occur for electronic devices in some scenarios. As can be observed from this discussion, systems and methods that reduce feedback may be beneficial.

SUMMARY

A method for feedback detection by an electronic device is described. The method includes receiving a first microphone signal by a first microphone. A feedback loop includes the first microphone and a speaker. The method also includes receiving a second microphone signal by a second microphone that is outside of the feedback loop. A first signal based on the first microphone signal and a second signal based on the second microphone signal exhibit a higher correlation in presence of feedback and exhibit a lower correlation in absence of feedback. The method further includes determining a correlation based on the first microphone signal and the second microphone signal. The method additionally includes determining whether feedback is occurring based on the correlation. Determining whether feedback is occurring may avoid detecting non-feedback sound as feedback. The second microphone may be located near the speaker.

Determining whether feedback is occurring may include determining that feedback is occurring when the correlation is above a threshold. Determining whether feedback is occurring may include determining that feedback is not occurring when the correlation is below a threshold.

The method may include adjusting processing of the first microphone signal when feedback is occurring. Adjusting processing may include reducing a gain and/or disconnecting the feedback loop.

The method may include filtering the first microphone signal to determine the first signal. The method may also include filtering the second microphone signal to determine the second signal.

Filtering the first microphone signal may include equalizing the first microphone signal based on a first filter. Filtering the second microphone signal may include equalizing the second microphone signal based on a second filter. The first filter may correspond to a non-feedback transfer function. The second filter may correspond to a feedback transfer function.

An electronic device for feedback detection is also described. The electronic device includes a first microphone configured to receive a first microphone signal. The electronic device also includes a speaker coupled to the first microphone. A feedback loop includes the first microphone and the speaker. The electronic device further includes a second microphone configured to receive a second microphone signal. The second microphone is outside of the feedback loop. A first signal based on the first microphone signal and a second signal based on the second microphone signal exhibit a higher correlation in presence of feedback and exhibit a lower correlation in absence of feedback. The electronic device additionally includes control circuitry coupled to the first microphone and to the second microphone. The control circuitry determines a correlation based on the first microphone signal and the second microphone signal. The control circuitry determines whether feedback is occurring based on the correlation.

A computer-program product for feedback detection is also described. The computer-program product includes a non-transitory tangible computer-readable medium with instructions. The instructions include code for causing an electronic device to receive a first microphone signal by a first microphone. A feedback loop includes the first microphone and a speaker. The instructions also include code for causing the electronic device to receive a second microphone signal by a second microphone that is outside of the feedback loop. A first signal based on the first microphone signal and a second signal based on the second microphone signal exhibit a higher correlation in presence of feedback and exhibit a lower correlation in absence of feedback. The instructions further include code for causing the electronic device to determine a correlation based on the first microphone signal and the second microphone signal. The instructions additionally include code for causing the electronic device to determine whether feedback is occurring based on the correlation.

An apparatus for feedback detection is also described. The apparatus includes a first means for receiving a first input signal. A feedback loop includes the first means for receiving and a speaker. The apparatus also includes a second means for receiving a second input signal. The second means for receiving is outside of the feedback loop. A first signal based on the first input signal and a second signal based on the second input signal exhibit a higher correlation in presence of feedback and exhibit a lower correlation in absence of feedback. The apparatus further includes means for determining a correlation based on the first input signal and the second input signal. The apparatus additionally includes means for determining whether feedback is occurring based on the correlation.

DETAILED DESCRIPTION

Some configurations of the systems and methods disclosed herein enable acoustic feedback detection utilizing a second (e.g., error) microphone signal. Acoustic feedback is a problem that may occur when a transducer (e.g., microphone) is coupled to a speaker via an electronic signal path. Examples of systems with this setup include hearing aids, public broadcast systems, voice megaphones and active noise cancellation (ANC) systems.

In active noise cancellation applications (e.g., in headsets and handsets), a noise microphone that picks up environmental noise is coupled to a speaker via an electronic signal path that processes the signal such that the speaker-generated signal makes destructive interference with incoming environmental noise. This setup can possibly develop acoustic feedback if the speaker-generated sounds leak back to the noise microphone. This acoustic feedback is an undesirable artifact of ANC systems. Accordingly, it would be beneficial to prevent this acoustic feedback.

Acoustic feedback may be prevented by detecting whether feedback is occurring and lowering the loop gain of the feedback system. One known detection approach includes computing a correlation between a noise microphone signal (e.g., N) and a filtered noise microphone signal (e.g., $F_pWN$, where $F_p$ denotes a feedback path transfer function and W denotes an electronic path transfer function). In this approach, if an acoustic signal (e.g., X) is random noise, the correlation will be high when there is a strong feedback signal in the noise microphone signal (e.g., N). However, this correlation-based criterion fails when the acoustic signal (e.g., X) itself is auto-correlated. Accordingly, this approach may not perform well in some scenarios.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

Figure 1:
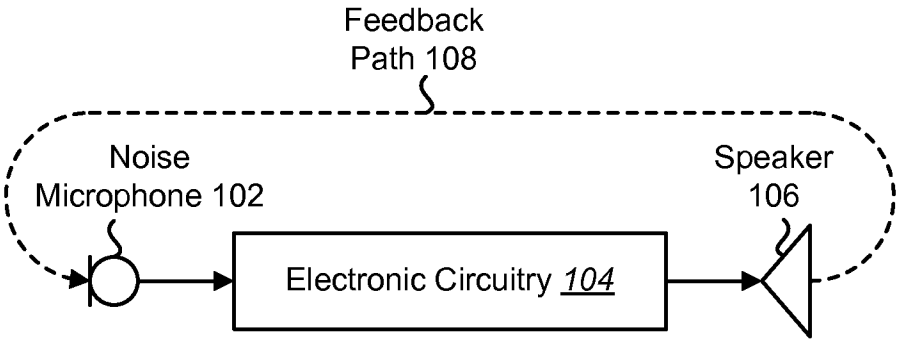
FIG. 1 is a block diagram illustrating a generic acoustic feedback scenario. In this scenario, a noise microphone is coupled to electronic circuitry.

FIG. 1 is a block diagram illustrating a generic acoustic feedback scenario. In this scenario, a noise microphone 102 is coupled to electronic circuitry 104. The electronic circuitry 104 is coupled to a speaker 106. The noise microphone 102 is coupled to the speaker 106 via the electronic circuitry. In this scenario, a feedback path 108 exists between the speaker 106 and the noise microphone 102. Accordingly, acoustic signals produced by the speaker 106 may be captured by the noise microphone 102.

One example of a known approach for feedback detection is given as follows. This example includes a microphone correlation approach for feedback detection. This known feedback detection and/or cancellation approach assumes one or more noise microphones 102 that are all connected to the electronic circuitry 104 (e.g., electronic path transfer function W). In the known approach for microphone feedback detection, correlation between signals derived from the noise microphone(s) 102 is used as a feedback detection method.

In this example, a transfer function corresponding to the feedback path 108 may be referred to as a feedback path transfer function $F_p$. A transfer function corresponding to the electronic circuitry 104 may be referred to as an electronic path transfer function W. X denotes an acoustic signal (e.g., environmental signal) being received by the noise microphone 102. N denotes the input signal (e.g., the electronic signal) captured by the noise microphone 102. In this example, $N=X+WF_pN$.

In this known approach, a correlation between the input signal and a predicted feedback signal is calculated. Accordingly, this known correlation-based detection approach is based only on signals derived from the noise microphone(s). In this approach, $$\frac{\mathrm{Corr}(N, WFN)}{Std(N)Std(WFN)} = \frac{\mathrm{Corr}(X + WFN, WFN)}{Std(X + WFN)Std(WFN)} = \frac{\mathrm{Corr}(X, WFN) + \mathrm{Corr}(WFN, WFN)}{Std(X + WFN)Std(WFN)},$$

where Corr( ) denotes a correlation function and Std( ) denotes a standard deviation function. The foregoing equation equates to 1.0 if Corr(X, WFN)==0 and WFN is very large compared to X. In many situations, however, sounds such as human voice include a significant amount of auto correlation (e.g., Corr(X, WFN) !=0). This known approach is different from the systems and methods disclosed herein.

In the systems and methods disclosed herein, one or more additional microphones (e.g., one or more error microphones besides the one or more noise microphones) are not included in a feedback loop. For example, one or more additional microphones may be utilized that are not in the feedback loop, which includes the noise microphone(s) 102, the electronic circuitry 104 (with electronic path transfer function W, for example), the speaker 106 and the feedback path 108. This is different from the known approach, which may only include one or more microphones in the feedback loop.

In some configurations of the systems and methods disclosed herein, the one or more additional microphones (e.g., error microphone(s)) utilized in accordance with the systems and methods disclosed herein may only be used for feedback detection. Additionally or alternatively, the signal(s) captured by the one or more additional microphones may not be directly provided to the electronic path (with electronic path transfer function W, for example). For example, the signal(s) from the additional microphone(s) may not be applied for direct cancellation of feedback (where feedback is predicted and subtracted, for example) in some configurations.

In some configurations, the systems and methods disclosed herein may be applied in conjunction with ANC. It should be noted that the detected feedback described may be applied to feedforward ANC (and not feedback ANC in some configurations, for example).

In a known approach, low correlation may occur in a feedback case because another microphone may be far from a speaker. Higher correlation may occur with a useful sound source in this known approach. However, that known approach is distinct from the systems and methods disclosed herein because the systems and methods known herein may provide high correlation in the feedback case (because a second microphone may be close to a speaker, for example). Furthermore, the systems and methods disclosed herein may provide low correlation in the case of an acoustical signal (due to specific pre-filtering, for example). Accordingly, the known approach described provides opposite correlation behavior and is distinct from the systems and methods disclosed herein.

Another known approach provides microphones connected to an amplifier in anti-phase relative to each other for anti-howling functionality. This is essentially utilizing a directional microphone. This approach may only be useful when feedback is relatively constant.

Some known approaches may be applied only for noise cancellation (e.g., feedback ANC). These known approaches may be distinct because they are applied for feedback ANC, whereas the systems and methods disclosed herein may be applied to feedforward ANC. Additionally or alternatively, one or more microphones in the systems and methods disclosed herein may not be included in the feedback loop, whereas some known ANC approaches only include one or more microphones within the feedback loop.

Figure 2:
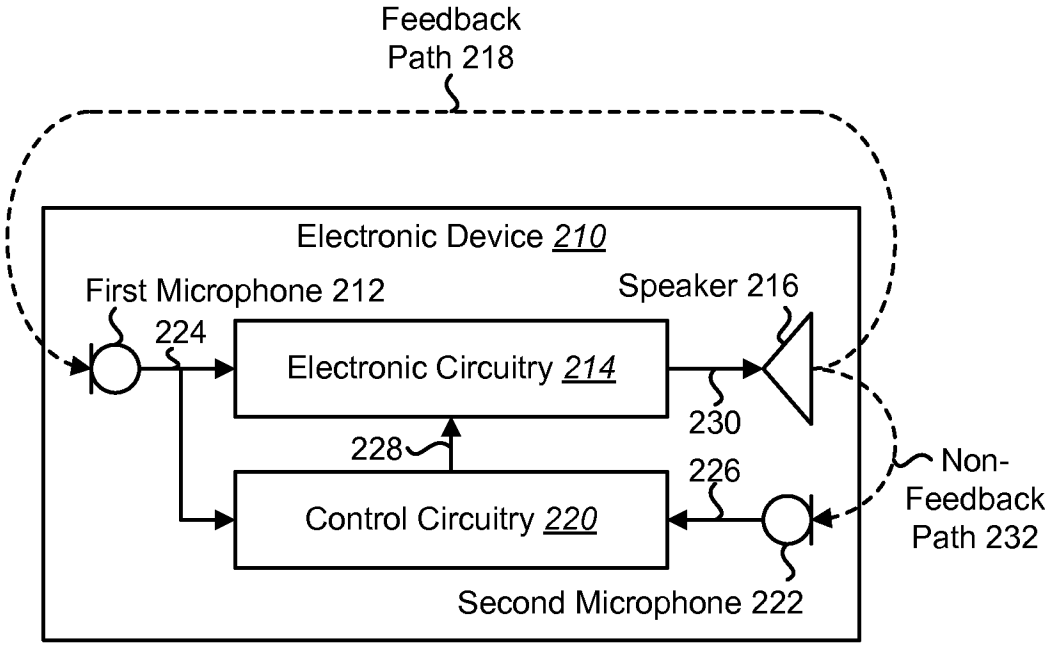
FIG. 2 is a block diagram illustrating one configuration of an electronic device in which systems and methods for feedback detection may be implemented.

FIG. 2 is a block diagram illustrating one configuration of an electronic device 210 in which systems and methods for feedback detection may be implemented. Examples of the electronic device 210 include smartphones, cellular phones, landline phones, tablet devices, computers (e.g., laptop computers, desktop computers, etc.), headsets (e.g., Bluetooth headsets, ANC headsets, headphones, etc.), voice recorders, personal digital assistants (PDAs), etc.

The electronic device 210 includes one or more first microphones 212 (e.g., noise microphones), electronic circuitry 214, one or more speakers 216, control circuitry 220 and one or more second microphones 222 (e.g., error microphones). The microphones 212, 222 may be transducers that convert acoustic signals into electronic signals. The one or more speakers 216 may be transducers that convert electronic signals into acoustic signals. The electronic circuitry 214 may be implemented in hardware or in a combination of hardware and software (e.g., a processor with instructions). The control circuitry 220 may be implemented in hardware or in a combination of hardware and software (e.g., a processor with instructions).

The one or more first microphones 212 may be coupled to the electronic circuitry 214 and to the control circuitry 220. The electronic circuitry 214 may be coupled to the speaker 216. The second microphone 222 may be coupled to the control circuitry 220. The control circuitry 220 may be coupled to the electronic circuitry 214. As used herein, the term "couple" and related terms may mean that one component is directly connected (without intervening components, for example) or indirectly connected (with one or more intervening components, for example) to another component. Arrows and/or lines depicted in the Figures may denote a coupling.

The systems and methods disclosed herein provide an approach to feedback detection. In this approach, a first microphone signal 224 (from one or more first microphones 212) and a second microphone signal 226 (from one or more second microphones 222) may be utilized to calculate correlation-based criteria. As illustrated in FIG. 2, the first microphone 212 (e.g., noise microphone) is coupled to the speaker 216 via the electronic circuitry 214 (e.g., electronic path transfer function W). A feedback loop may include the first microphone(s) 212, the electronic circuitry 214 (e.g., electronic path transfer function W), the speaker 216 and a feedback path 218. However, the feedback loop may not include the non-feedback path 232, the second microphone(s) 222 or the control circuitry 220. The one or more second microphones 222 (e.g., error microphone(s)) may receive acoustic signals from the speaker 216 via the non-feedback path.

In some configurations, the second microphone 222 may be located near the speaker 216. For example, the second microphone(s) 222 (e.g., error microphone(s)) may be located closer to the speaker 216 than the first microphone(s) 212 (e.g., noise microphone(s)). Additionally or alternatively, the second microphone(s) 222 may be located adjacent to the speaker 216, close enough that both the speaker 216 and the second microphone 222 are covered by or within a user's ear pinna during use and/or such that both the speaker 216 and the second microphone 222 are within a headphone or headset ear cup, etc.). Additionally or alternatively, the speaker 216 may be typically isolated from the first microphone(s) 212 but may not be isolated from the second microphone(s) 222. For example, a user's ear pinna and/or an ear cup or housing of the electronic device 210 may provide a barrier between the speaker 216 and the first microphone(s) 212. However, the isolation between the speaker 216 and the first microphone(s) 212 may break down in some cases (e.g., when the barrier does not adequately attenuate acoustic signals output by the speaker 216). The systems and methods disclosure herein may be utilized to detect when feedback occurs, which may indicate a break down in isolation between the speaker 216 and the first microphone(s) 212.

The one or more first microphones 212 may be configured to receive a first microphone signal 224 (e.g., a first input signal). For example, the one or more first microphones 212 may capture acoustic signals (e.g., environmental sounds, noise and/or signals produced by the speaker 216, etc.). The one or more first microphones 212 may convert the acoustic signals to the first microphone signal 224 (e.g., an electronic signal corresponding to the acoustic signals). The first microphone signal 224 may be provided to the electronic circuitry 214 and to the control circuitry 220.

The electronic circuitry 214 may process the first microphone signal 224. For example, the electronic circuitry 214 may amplify, filter (e.g., provide gain and/or attenuation in one or more bands, add a delay, invert, etc.) and/or otherwise process the first microphone signal 224. The electronic circuitry 214 may provide a processed first microphone signal 230 to the speaker 216. One example of the electronic circuitry 214 is ANC circuitry that inverts the first microphone signal 224 such that the processed first microphone signal 230 that is output by the speaker 216 creates destructive interference with acoustic signals and/or noise in order to attenuate or cancel the acoustic signals and/or noise. In some configurations, the electronic circuitry 214 may exhibit a low latency (e.g., 5 milliseconds (ms) or less).

In some configurations, an echo path may be defined as a path between a speaker (e.g., speaker 216) and a microphone (e.g., first microphone 212). For example, in the case of echo, there may be a larger delay between the input captured by a microphone and the signal produced by the speaker. For instance, the input signal may be provided to a remote place (e.g., far end or storage). A signal may be obtained from the remote place or storage after a larger delay, which may be provided to the speaker. When the resulting signal output by the speaker is captured by the microphone, this may be referred to as echo via an echo path.

The speaker 216 is coupled to the first microphone(s) 212 (via the electronic circuitry 214, for example). As described above, the feedback loop includes the first microphone(s) 212 and the speaker 216. The speaker 216 may output an acoustic signal based on the processed first microphone signal 230. The acoustic signal may travel to the second microphone(s) 222 via a non-feedback path 232. In some cases, the acoustic signal may travel (e.g., leak) to the first microphone(s) 212 via the feedback path 218. For example, the acoustic signal output by the speaker 216 may travel to the first microphone 212 when a breakdown in isolation between the speaker 216 and the first microphone 212 occurs.

The second microphone(s) 222 may be configured to receive a second microphone signal 226 (e.g., a second input signal). For example, the second microphone(s) 222 may convert acoustic signals into the second microphone signal 226 (e.g., an electronic signal). As described above, the second microphone(s) 222 are outside of the feedback loop (e.g., the feedback loop does not include the second microphone(s) 222). In some configurations, the second microphone signal 226 may not be applied for feedback cancellation or subtraction techniques (e.g., the second microphone signal 226 itself may not be utilized to create destructive interference). For example, the second microphone signal 226 may only be applied for feedback detection in some configurations. The second microphone signal 226 may be provided to the control circuitry 220.

In some configurations, the control circuitry 220 may determine a first signal based on the first microphone signal 224 and/or may determine a second signal based on the second microphone signal 226. For example, the control circuitry 220 may filter the first microphone signal 224 to determine the first signal and/or may filter the second microphone signal 226 to determine the second signal. For instance, filtering the first microphone signal 224 may include amplifying (e.g., applying a gain to) the first microphone signal 224 (or one or more bands thereof), attenuating the first microphone signal 224 (or one or more bands thereof), applying a delay to the first microphone signal 224, convolving the first microphone signal 224 with a first filter and/or performing other operation(s) on the first microphone signal 224. In some configurations, the control circuitry 220 may equalize the first microphone signal 224 based on a first filter to determine the first signal. For example, the control circuitry 220 may convolve the first microphone signal 224 (e.g., N) with a first filter corresponding to a non-feedback transfer function (e.g., S) to determine the first signal. The non-feedback transfer function may be a transfer function from after the electronic circuitry 214 to the second microphone(s) 222, including the speaker 216. In some configurations, a single-tap filter may be utilized to model the non-feedback transfer function (e.g., S=1).

Filtering the second microphone signal 226 may include amplifying (e.g., applying a gain to) the second microphone signal 226 (or one or more bands thereof), attenuating the second microphone signal 226 (or one or more bands thereof), applying a delay to the second microphone signal 226, convolving the second microphone signal 226 with a second filter and/or performing other operation(s) on the second microphone signal 226. In some configurations, the control circuitry 220 may equalize the second microphone signal 226 based on a second filter to determine the second signal. For example, the control circuitry 220 may convolve the second microphone signal 226 (e.g., E) with a second filter corresponding to a feedback transfer function (e.g., F) to determine the second signal. The feedback transfer function may be a transfer function from after the electronic circuitry 214 to the first microphone(s) 212, not including the speaker 216. In some configurations, a single-tap filter may be utilized to model the feedback transfer function (e.g., F=−1).

The first signal (based on the first microphone signal 224) and the second signal (based on the second microphone signal 226) may exhibit a higher correlation in presence of feedback and exhibit a lower correlation in absence of feedback. For example, because the second microphone 222 is located near the speaker 216, the second signal exhibits a higher correlation with the first signal in the presence of feedback because the second signal exhibits similarity to the first signal when the acoustic signal output by the speaker 216 leaks to the first microphone 212. In this case, the first signal and the second signal exhibit correlation, having originated from the same source. However, the first signal and the second signal exhibit a lower correlation in the absence of feedback. This is because the first signal and the second signal are typically dissimilar in the absence of feedback.

The control circuitry 220 may determine a correlation based on the first microphone signal 224 and the second microphone signal 226. For example, the control circuitry 220 may determine a correlation between the first signal (which is based on the first microphone signal 224) and the second signal (which is based on the second microphone signal 226). In some configurations, the control circuitry 220 may determine a normalized correlation between the first signal and the second signal. For example, the control circuitry 220 may divide the correlation of the first signal and the second signal by a standard deviation of the first signal and a standard deviation of the second signal. In another example, the control circuitry 220 may divide the correlation of the first signal and the second signal by a variance of the second signal.

The control circuitry 220 may determine whether feedback is occurring based on the correlation (e.g., based on the correlation or normalized correlation). For example, the control circuitry 220 may determine that feedback is occurring when the correlation is above a threshold. Additionally, the control circuitry 220 may determine that feedback is not occurring when the correlation is below the same or a different threshold. In some configurations, the control circuitry 220 may utilize multiple thresholds, where a scale of thresholds indicates amounts of feedback. For example, if the correlation is below a first threshold, the control circuitry 220 may determine that feedback is not occurring. If the correlation is above the first threshold but below the second threshold, the control circuitry 220 may determine that a small amount of feedback is occurring. If the correlation is above the second threshold, the control circuitry 220 may determine that a large amount of feedback is occurring. Determining whether feedback is occurring in accordance with the systems and methods disclosed herein may avoid detecting non-feedback sound (e.g., voice) as feedback.

The control circuitry 220 may adjust processing of the first microphone signal 224 when feedback is occurring. For example, the control circuitry 220 may reduce a gain (e.g., loop gain) and/or may disconnect the feedback loop when feedback is occurring. In some configurations, the control circuitry 220 may generate a control signal 228 based on whether feedback is occurring. For example, the control signal 228 may include a binary indicator that indicates whether feedback is occurring. Additionally or alternatively, the control signal 228 may provide other control information. For example, the control signal 228 may change a voltage and/or current level that causes the electronic circuitry 214 to reduce a gain. Additionally or alternatively, the control signal 228 may provide a switch signal (e.g., a current or voltage) that causes a switch (e.g., transistor) to disconnect the path between the first microphone(s) 212 and the speaker 216.

One benefit of the systems and methods disclosed herein is that the multiple microphone-based feedback detection approach (including at least one microphone in the feedback loop and at least one microphone outside of the feedback loop) provides accurate discrimination between acoustic voice and feedback sounds. For example, the systems and methods disclosed herein may avoid detecting a far-end speech in a voice call as feedback in some configurations. Known approaches (that only utilize one or more microphones in the feedback loop, for example) that utilize correlation may suffer from many false positives triggered by human voice.

The systems and methods disclosed herein also utilize spatial diversity provided by the first microphone signal 224 and the second microphone signal 226 and provide additional discrimination between acoustic signals and local feedback sounds. This is not possible in a single microphone-based approach.

Some configurations of the systems and methods disclosed herein may be useful with handset ANC applications, where the second microphone 222 (e.g., error microphone) is located near the speaker 216 (e.g., receiver). For example, smartphone design frequently allows an open air path between speaker's 216 (e.g., receiver's) back side and the first microphone 212 (e.g., noise microphone). Due to various design constraints, small mobile devices with ANC functionality may have the second microphone (e.g., error microphone) close to the speaker 216 (e.g., receiver) and the receiver may utilize an open air volume on its back side to ensure improved acoustic performance. In accordance with the systems and methods disclosed herein, the speaker's 216 back side may be isolated from the second microphone(s) 222 (e.g., error microphones).

Figure 3:
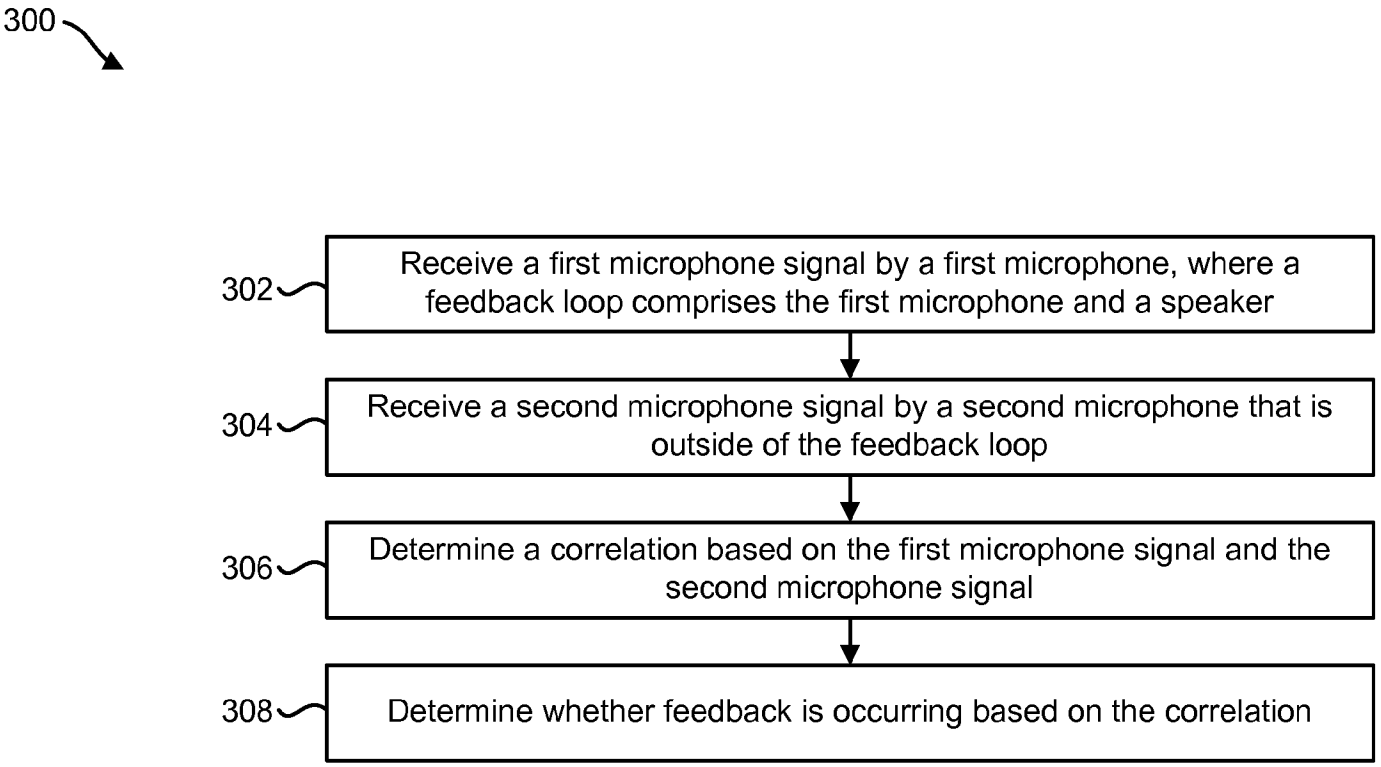
FIG. 3 is a flow diagram illustrating one configuration of a method for feedback detection by an electronic device.

FIG. 3 is a flow diagram illustrating one configuration of a method 300 for feedback detection by an electronic device 210. The electronic device 210 may receive 302 a first microphone signal 224 by one or more first microphones 212. This may be accomplished as described above in connection with FIG. 2. A feedback loop may include the one or more first microphones 212 and one or more speakers 216.

The electronic device 210 may receive 304 a second microphone signal 226 by one or more second microphones 222 that are outside the feedback loop. This may be accomplished as described above in connection with FIG. 2, for example. The second microphone(s) 222 may be located near the speaker 216. This may enable determination of a higher correlation when feedback is occurring and a lower correlation when feedback is not occurring. As described above, a first signal based on the first microphone signal 224 and a second signal based on the second microphone signal 226 may exhibit a higher correlation in the presence of feedback and may exhibit a lower correlation in absence of feedback. Accordingly, determining whether feedback is occurring in this way may avoid detecting non-feedback sound as feedback.

In some configurations, the electronic device 210 may filter the first microphone signal 224 to determine the first signal and may filter the second microphone signal 226 to determine the second signal. This may be accomplished as described above in connection with FIG. 2. For example, filtering the first microphone signal 224 may include equalizing the first microphone signal 224 based on a first filter and filtering the second microphone signal 226 may include equalizing the second microphone signal 226 based on a second filter. In particular, the first filter may correspond to a non-feedback transfer function and the second filter may correspond to a feedback transfer function.

The electronic device 210 may determine 306 a correlation based on the first microphone signal 224 and the second microphone signal 226. This may be accomplished as described above in connection with FIG. 2. For example, the electronic device 210 may determine 306 a correlation (e.g., normalized correlation) based on a first signal and a second signal.

The electronic device 210 may determine 308 whether feedback is occurring based on the correlation (e.g., based on the correlation or normalized correlation). This may be accomplished as described above in connection with FIG. 2, for example. In some configurations, determining whether feedback is occurring may include determining that feedback is occurring when the correlation is above a threshold and/or determining that feedback is not occurring when the correlation is below the same or a different threshold.

In some configurations, the electronic device 210 may adjust processing of the first microphone signal 224 when feedback is occurring. This may be accomplished as described above in connection with FIG. 2. For example, adjusting processing may include reducing a gain and/or disconnecting the feedback loop.

Figure 4:
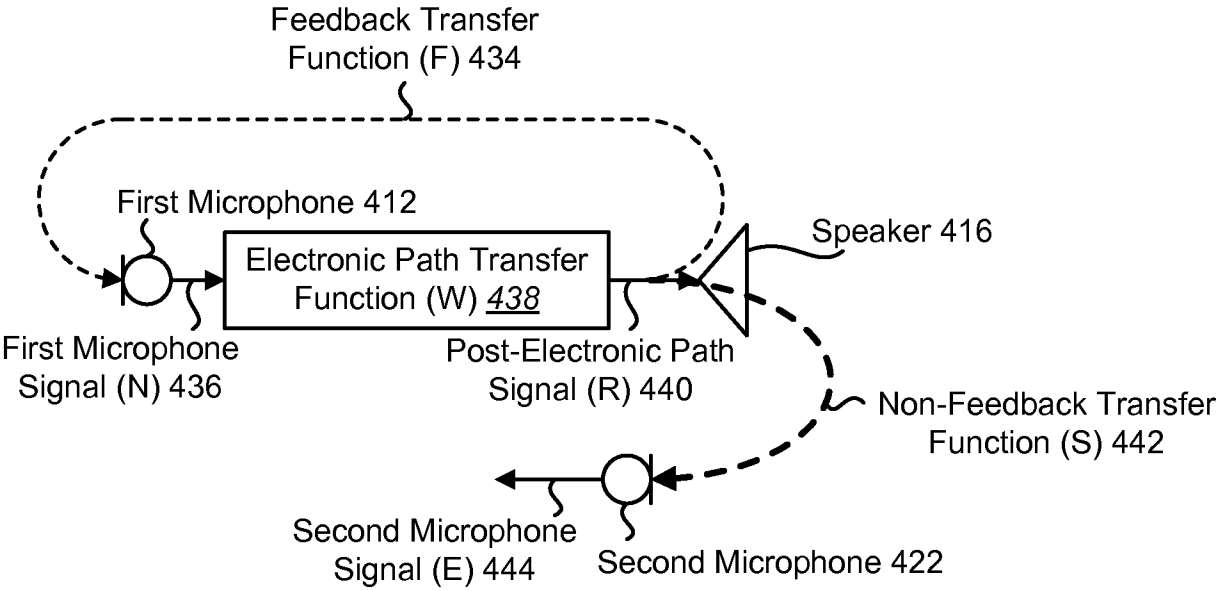
FIG. 4 is a block diagram illustrating one example of a multiple microphone feedback detection scenario in accordance with the systems and methods disclosed herein.

FIG. 4 is a block diagram illustrating one example of a multiple microphone (e.g., dual microphone) feedback detection scenario in accordance with the systems and methods disclosed herein. In particular, FIG. 4 illustrates one or more first microphones 412, a first microphone signal 436 (denoted N), an electronic path transfer function 438 (denoted W), a post-electronic path signal 440 (denoted R), a feedback transfer function 434 (denoted F), one or more speakers 416, a non-feedback transfer function 442 (denoted S), one or more second microphones 422 and a second microphone signal 444 (denoted E). The first microphone(s) 412, the second microphone(s) 422 and the speaker(s) 416 described in connection with FIG. 4 may correspond to the first microphone(s) 212, the second microphone(s) 222 and the speaker(s) 216 described in connection with FIG. 2.

The electronic path transfer function 438 (W) may model the response of the electronic circuitry 214 described in connection with FIG. 2, for example. The post-electronic path signal 440 (R) is the signal after electronic path transfer function 438 (W), but before the speaker 416. For example, the post-electronic path signal 440 (R) may be the signal that is output from the electronic path transfer function 438 (W), but before output by the speaker 416. The transfer function from the post-electronic path signal 440 (R) to the second microphone signal 444 (E) (e.g., at the second microphone 422 or error microphone) may be modeled as the non-feedback transfer function 442 (S). It should be noted that the non-feedback transfer function 442 (S) (e.g., a transfer function corresponding to a speaker 416 path) may model the path through the speaker 416. Additionally, the transfer function (e.g., leak) from the post-electronic path signal 440 (R) to the first microphone signal 436 (N) (e.g., at the first microphone 412 or noise microphone) may be modeled as the feedback transfer function 434 (F). It should be noted that the feedback transfer function 434 (F) may not model the path through the speaker 416 in some configurations. Accordingly, the feedback transfer function 434 (F) may or may not directly model the feedback path $F_p$ described above. It should be noted that the first microphone(s) 412 may be included in a feedback loop with the speaker(s) 416 as described above in connection with FIG. 2. For example, a version of the first microphone signal 436 (N) (e.g., the first microphone signal 436 (N) as affected by the electronic path transfer function 438 (W)) may be output by the speaker 416. However, the second microphone signal 444 (E) itself may not be provided (e.g., coupled through) to the speaker 416, for example. For instance, a separate control signal that is based on the second microphone signal 444 (E) may indicate whether feedback is occurring and/or may provide control information.

The first microphone signal 436 (N) received by the first microphone 412 may be expressed as: N=FR. The second microphone signal 444 (E) received by the second microphone 422 may be expressed as: E=SR. Accordingly, FE=FSR=SN=SFR. Thus, calculating a normalized correlation of FE and SN should yield 1. For example, the normalized correlation of FE and SN may be expressed as:

$$\frac{\mathrm{Corr}(FE, SN)}{Std(FE)Std(SN)} = \frac{\mathrm{Corr}(Y, Y)}{Std(Y)Std(Y)} = 1.0.$$

Y may be an arbitrary signal. Accordingly, the normalized correlation still gives 1.0, even with unknown linear gains g and h. For example, with E=gSR and N=hFR, $$\frac{\mathrm{Corr}(gFSR, hSFR)}{Std(gFSR)Std(hFSR)} = 1.0.$$

In many cases, a simplified model of transfer functions F and S may be utilized. In some configurations, for example, one tap filters may be used to model F and S. For instance, F=−1 and S=1 may be utilized as the simplified model of the transfer functions. In these configurations, $$\frac{\mathrm{Corr}(-E, R)}{Std(E)Std(R)} = \frac{\mathrm{Corr}(Y, Y)}{Std(Y)Std(Y)} = 1.0.$$

The systems and methods disclosed herein are better at rejecting an acoustic signal than known approaches (e.g., single microphone-based approaches).

Figure 5:
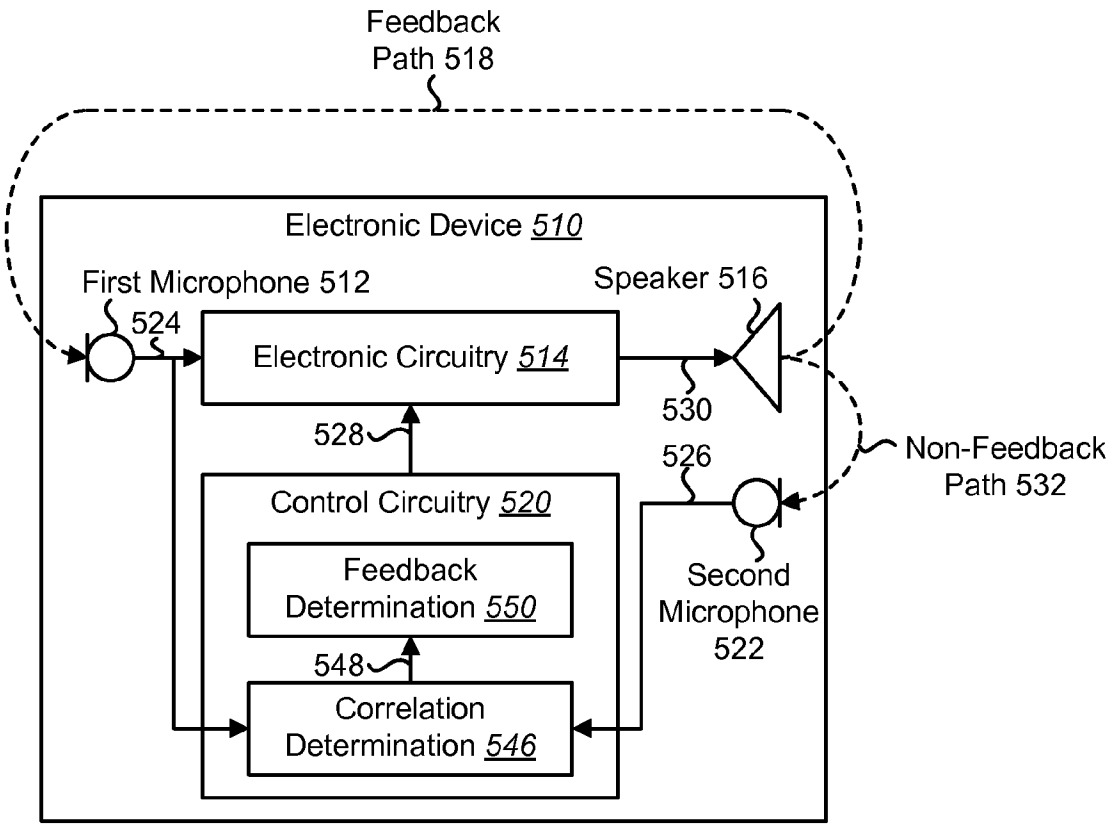
FIG. 5 is a block diagram illustrating a more specific configuration of an electronic device in which systems and methods for feedback detection may be implemented.

FIG. 5 is a block diagram illustrating a more specific configuration of an electronic device 510 in which systems and methods for feedback detection may be implemented. The electronic device 510 may be one example of the electronic device 210 described in connection with FIG. 2. The electronic device 510 includes one or more first microphones 512 (e.g., noise microphones), electronic circuitry 514, one or more speakers 516, control circuitry 520 and one or more second microphones 522 (e.g., error microphones). One or more of these components may be examples of corresponding components described in connection with FIG. 2. Additionally, one or more of the components of the electronic device 510 may operate in accordance with one or more of the functions, procedures and/or examples described in connection with FIGS. 2-4.

As described above, the one or more first microphones 512 may be configured to receive a first microphone signal 524. The one or more first microphones 512 may convert the acoustic signals to the first microphone signal 524, which may be provided to the electronic circuitry 514 and to the control circuitry 520.

As described above, the electronic circuitry 514 may process the first microphone signal 524 and may provide a processed first microphone signal 530 to the speaker 516. For example, the electronic circuitry 514 may be ANC circuitry in some configurations. As described above, the feedback loop includes the first microphone(s) 512 and the speaker 516. The speaker 516 may output an acoustic signal based on the processed first microphone signal 530, which may travel to the second microphone(s) 522 via a non-feedback path 532 and/or may travel (e.g., leak) to the first microphone(s) 512 via the feedback path 518.

The second microphone(s) 522 may be configured to receive a second microphone signal 526, which may be provided to the control circuitry 520. The control circuitry 520 may include a correlation determination module 546 and a feedback determination module 550. As used herein, the term "module" may indicate that a component may be implemented in hardware or a combination of hardware and software (e.g., a processor with instructions).

The correlation determination module 546 may receive the first microphone signal 524 (e.g., a first signal based on the first microphone signal 524) and the second microphone signal 526 (e.g., a second signal based on the second microphone signal 526). The correlation determination module 546 may determine a correlation 548 (e.g., a normalized correlation) based on the first microphone signal 524 and the second microphone signal 526. For example, the correlation determination module 546 may determine a correlation 548 between the first signal (which is based on the first microphone signal 524) and the second signal (which is based on the second microphone signal 526). In some configurations, the correlation determination module 546 may determine a normalized correlation 548 between the first signal and the second signal. For example, the correlation determination module 546 may divide the correlation of the first signal and the second signal by a standard deviation of the first signal and a standard deviation of the second signal. In another example, the correlation determination module 546 may divide the correlation of the first signal and the second signal by a variance of the second signal. The correlation determination module 546 may provide the correlation 548 (e.g., normalized correlation 548) to the feedback determination module 550.

The feedback determination module 550 may determine whether feedback is occurring based on the correlation 548 (e.g., based on the correlation 548 or normalized correlation 548). For example, the feedback determination module 550 may determine that feedback is occurring when the correlation 548 is above a threshold. Additionally, the feedback determination module 550 may determine that feedback is not occurring when the correlation is below the same or a different threshold. In some configurations, the feedback determination module 550 may utilize multiple thresholds, where a scale of thresholds indicates a degree or amount of correlation. For example, if the correlation is below a first threshold, the feedback determination module 550 may determine that feedback is not occurring. If the correlation is above the first threshold but below the second threshold, the feedback determination module 550 may determine that a small amount of feedback is occurring. If the correlation is above the second threshold, the feedback determination module 550 may determine that a large amount of feedback is occurring. Determining whether feedback is occurring in accordance with the systems and methods disclosed herein may avoid detecting non-feedback sound (e.g., voice) as feedback.

The control circuitry 520 may adjust processing of the first microphone signal 524 when feedback is occurring (e.g., when the feedback determination module 550 determines that feedback is occurring). For example, the control circuitry 520 may reduce a gain (e.g., loop gain) and/or may disconnect the feedback loop when feedback is occurring. In some configurations, the control circuitry 520 may generate a control signal 528 based on whether feedback is occurring. For example, the control signal 528 may include a binary indicator that indicates whether feedback is occurring. Additionally or alternatively, the control signal 528 may provide other control information. For example, the control signal 528 may change a voltage and/or current level that causes the electronic circuitry 514 to reduce a gain. Additionally or alternatively, the control signal 528 may provide a switch signal (e.g., a current or voltage) that causes a switch (e.g., transistor) to disconnect the path between the first microphone(s) 512 and the speaker 516.

Figure 6:
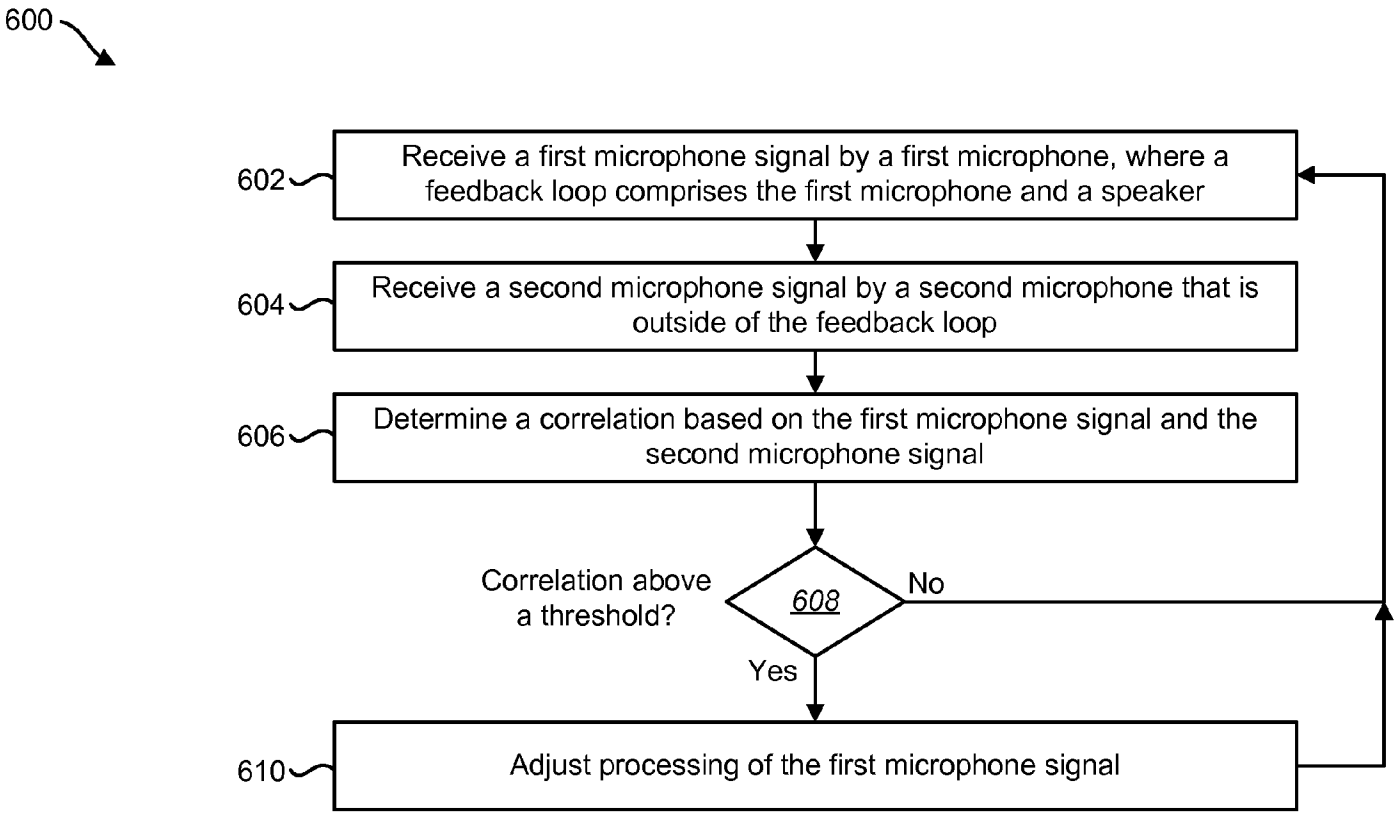
FIG. 6 is a flow diagram illustrating a more specific configuration of a method for feedback detection by an electronic device.

FIG. 6 is a flow diagram illustrating a more specific configuration of a method 600 for feedback detection by an electronic device 510. The electronic device 510 may receive 602 a first microphone signal 524 by one or more first microphones 512. This may be accomplished as described above in connection with one or more of FIGS. 2-5. A feedback loop may include the one or more first microphones 512 and one or more speakers 516.

The electronic device 510 may receive 604 a second microphone signal 526 by one or more second microphones 522 that are outside the feedback loop. This may be accomplished as described above in connection with one or more of FIGS. 2-5, for example.

The electronic device 510 may determine 606 a correlation 548 based on the first microphone signal 524 and the second microphone signal 526. This may be accomplished as described above in connection with one or more of FIGS. 2-5. For example, the electronic device 510 may determine 606 a correlation 548 (e.g., normalized correlation 548) based on a first signal and a second signal.

The electronic device 510 may determine 608 whether the correlation 548 is above a threshold. This may be accomplished as described above in connection with one or more of FIGS. 2-3 and 5. For example, the electronic device 510 (e.g., feedback determination module 550) may determine that feedback is occurring when the correlation 548 is above a threshold. In some configurations, the electronic device 510 (e.g., feedback determination module 550) may determine that feedback is not occurring when the correlation is below the same or a different threshold.

In some configurations, the electronic device 510 may utilize multiple thresholds, where a scale of thresholds indicates a degree or amount of correlation. For example, if the correlation is below a first threshold, electronic device 510 may determine that feedback is not occurring. If the correlation is above the first threshold but below the second threshold, the electronic device 510 may determine that a small amount of feedback is occurring. If the correlation is above the second threshold, the electronic device 510 may determine that a large amount of feedback is occurring. In some configurations, the degree or amount of correlation may be utilized to determine how to adjust processing of the first microphone signal 524.

If the correlation 548 is not above (e.g., less than or equal to) the threshold (e.g., if the correlation 548 is not above a lowest threshold, indicating that no feedback is occurring), the electronic device 510 may return to repeat the method 600 or operation may end. If the correlation 548 is above (e.g., greater than) the threshold, the electronic device 510 may adjust 610 processing of the first microphone signal. This may be accomplished as described above in connection with one or more of FIGS. 2-3 and 5. For example, the electronic device (e.g., control circuitry 520) may adjust 610 processing by reducing a gain and/or disconnecting the feedback loop.

In some configurations, adjusting 610 processing of the first microphone signal 524 may include different operations based on whether the correlation 548 is above one or multiple thresholds (which may indicate an amount or degree of feedback). In one example, if the correlation 548 is above a first threshold but below a second threshold (which may indicate a small amount of correlation), the electronic device 510 (e.g., control circuitry 520) may reduce the gain of the electronic circuitry 514. If the correlation is above the second threshold (and the first threshold), the electronic device 510 (e.g., control circuitry 520) may disconnect the feedback loop. In another example, the electronic device 510 (e.g., control circuitry 520) may reduce the gain by a first amount if the correlation 548 is only above a first threshold. Additionally, the electronic device 510 (e.g., control circuitry 520) may reduce the gain by a second amount (that is greater than the first amount, for instance) if the correlation 548 is only above a second threshold (that is greater than the first threshold). Furthermore, the electronic device 510 (e.g., control circuitry 520) may disconnect the feedback loop if the correlation is above a third threshold (that is greater than the first and second thresholds). Accordingly, the electronic device 510 may adjust 610 processing differently (e.g., to differing degrees and/or using differing operations) based on the amount of correlation (e.g., based on the amount of correlation on a scale of multiple thresholds).

Figure 7:
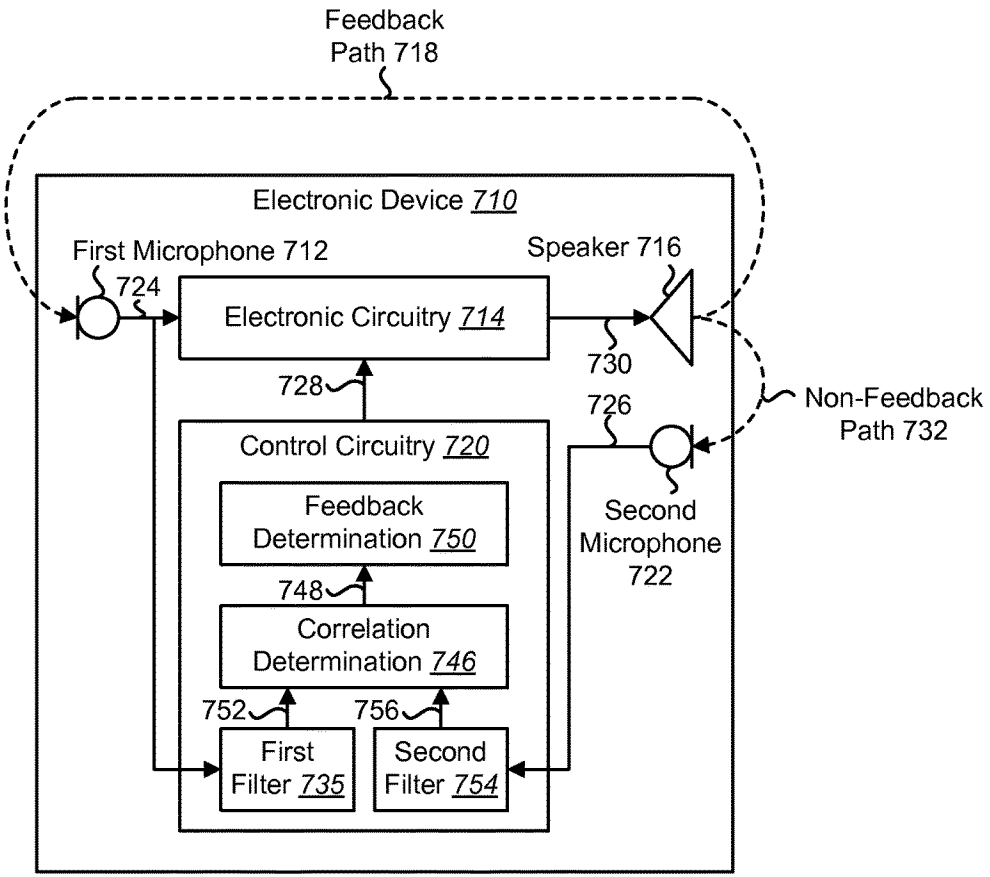
FIG. 7 is a block diagram illustrating another more specific configuration of an electronic device in which systems and methods for feedback detection may be implemented.

FIG. 7 is a block diagram illustrating another more specific configuration of an electronic device 710 in which systems and methods for feedback detection may be implemented. The electronic device 710 may be one example of one or more of the electronic devices 210, 510 described in connection with FIGS. 2 and 5. The electronic device 710 includes one or more first microphones 712 (e.g., noise microphones), electronic circuitry 714, one or more speakers 716, control circuitry 720 and one or more second microphones 722 (e.g., auxiliary or error microphones). One or more of these components may be examples of corresponding components described in connection with one or more of FIGS. 2 and 5. Additionally, one or more of the components of the electronic device 710 may operate in accordance with one or more of the functions, procedures and/or examples described in connection with FIGS. 2-6.

As described above, the one or more first microphones 712 may be configured to receive a first microphone signal 724. The first microphone signal 724 may be provided to the electronic circuitry 714 and to the control circuitry 720.

As described above, the electronic circuitry 714 may process the first microphone signal 724 and may provide a processed first microphone signal 730 to the speaker 716. The electronic circuitry 714 may be ANC circuitry in some configurations. The speaker 716 may output an acoustic signal based on the processed first microphone signal 730, which may travel to the second microphone(s) 722 via a non-feedback path 732 and/or may travel (e.g., leak) to the first microphone(s) 712 via the feedback path 718.

The second microphone(s) 722 may be configured to receive a second microphone signal 726, which may be provided to the control circuitry 720. The control circuitry 720 may include a first filter 735, a second filter 754, a correlation determination module 746 and a feedback determination module 750.

The first filter 735 may receive the first microphone signal 724. The first filter 735 may filter the first microphone signal 724 to determine a first signal 752. For instance, filtering the first microphone signal 724 may include amplifying (e.g., applying a gain to) the first microphone signal 724 (or one or more bands thereof), attenuating the first microphone signal 724 (or one or more bands thereof), applying a delay to the first microphone signal 724, convolving the first microphone signal 724 with the first filter 735 and/or performing other operation(s) on the first microphone signal 724. In some configurations, the first filter 735 may equalize the first microphone signal 724 to determine the first signal 752. For example, the first microphone signal 724 (e.g., N) may be convolved with the first filter 735 to determine the first signal 752. The first filter 735 may correspond to a non-feedback transfer function (e.g., S). The non-feedback transfer function may be a transfer function from the processed first microphone signal (e.g., a post-electronic path signal R) after the electronic circuitry 714 to the second microphone(s) 722, including the speaker 716. Accordingly, the first signal 752 (e.g., an equalized first microphone signal 724) may be expressed as SN (or its time-domain equivalent, for example). In some configurations, the first filter 735 may be a single-tap filter utilized to model the non-feedback transfer function (e.g., S=1). The first signal 752 may be provided to the correlation determination module 746.

The second filter 754 may receive the second microphone signal 726. The second filter 754 may filter the second microphone signal 726 to determine a second signal 756. For instance, filtering the second microphone signal 726 may include amplifying (e.g., applying a gain to) the second microphone signal 726 (or one or more bands thereof), attenuating the second microphone signal 726 (or one or more bands thereof), applying a delay to the second microphone signal 726, convolving the second microphone signal 726 with the second filter 754 and/or performing other operation(s) on the second microphone signal 726. In some configurations, the second filter 754 may equalize the second microphone signal 726 to determine the second signal 756. For example, the second microphone signal 726 (e.g., E) may be convolved with the second filter 754 to determine the second signal 756. The second filter 754 may correspond to a feedback transfer function (e.g., F). The feedback transfer function may be a transfer function from the processed first microphone signal (e.g., a post-electronic path signal R) after the electronic circuitry 714 to the first microphone(s) 712, not including the speaker 716. Accordingly, the second signal 756 (e.g., an equalized second microphone signal 726) may be expressed as FE (or its time-domain equivalent, for example). In some configurations, the second filter 754 may be a single-tap filter utilized to model the feedback transfer function (e.g., F=−1). The second signal 756 may be provided to the correlation determination module 746.

The first signal 752 (based on the first microphone signal 724) and the second signal 756 (based on the second microphone signal 726) may exhibit a higher correlation in presence of feedback and exhibit a lower correlation in absence of feedback. Utilizing the first filter 735 and the second filter 754 before the correlation computation may be beneficial for the discrimination of acoustical sound from a feedback signal. For example, multiplying (e.g., equalizing) the first microphone signal 724 (e.g., N) with the first filter 735 (e.g., S) (or convolving time-domain equivalents, for instance) may generate the first signal 752. Furthermore, multiplying (e.g., equalizing) the second microphone signal 726 (e.g., E) with the second filter (e.g., F) (or convolving time-domain equivalents, for instance) may generate the second signal 756. Without the first filter 735 and the second filter 754 (e.g., the S and F filters), acoustical sound may show high correlation more frequently. This may make discrimination between feedback and acoustic sounds (e.g., voice) more difficult.

The correlation determination module 746 may receive the first signal 752 and the second signal 756. The correlation determination module 746 may determine a correlation 748 (e.g., a normalized correlation) based on the first signal 752 and the second signal 756. For example, the correlation determination module 746 may determine a correlation 748 between the first signal 752 and the second signal 756 (e.g., Corr(FE, SN)). In some configurations, the correlation determination module 746 may determine a normalized correlation 748 between the first signal 752 and the second signal 756. For example, the correlation determination module 746 may divide the correlation of the first signal 752 and the second signal 756 by a standard deviation of the first signal 752 and a standard deviation of the second signal 756

$$\left(\text{e.g., } \frac{\text{Corr}(FE, SN)}{Std(FE)Std(SN)}\right).$$

In another example, the correlation determination module 746 may divide the correlation of the first signal 752 and the second signal 756 by a variance of the second signal 756

$$\left(\text{e.g., } \frac{\text{Corr}(FE, SN)}{\text{Var}(FE)}\right).$$

The correlation determination module 746 may provide the correlation 748 (e.g., normalized correlation 748) to the feedback determination module 750.

The feedback determination module 750 may determine whether feedback is occurring based on the correlation 748 (e.g., based on the correlation 748 or normalized correlation 748). For example, the feedback determination module 750 may determine that feedback is occurring when the correlation 748 is above a threshold (e.g., Corr(FE, SN)>Threshold). Additionally, the feedback determination module 750 may determine that feedback is not occurring when the correlation is below (e.g., less than or equal to) the same or a different threshold. In some configurations, the feedback determination module 750 may utilize multiple thresholds, where a scale of thresholds indicates a degree or amount of correlation (as described above in connection with FIG. 6, for example).

The control circuitry 720 may adjust processing of the first microphone signal 724 when feedback is occurring (e.g., when the correlation 748 is above a threshold). For example, the control circuitry 720 may reduce a gain (e.g., loop gain) and/or may disconnect the feedback loop when feedback is occurring. In some configurations, the control circuitry 720 may generate a control signal 728 based on whether feedback is occurring as described above in connection with one or more of FIGS. 2 and 5. In some configurations, the control signal 728 may indicate different operations based on the amount of correlation 748 as described above. For example, the control signal 728 may indicate a small gain reduction if the correlation 748 is above a first threshold, may indicate a larger gain reduction if the correlation 748 is above a second threshold and may indicate feedback loop disconnection if the correlation 748 is above a third threshold.

Figure 8:
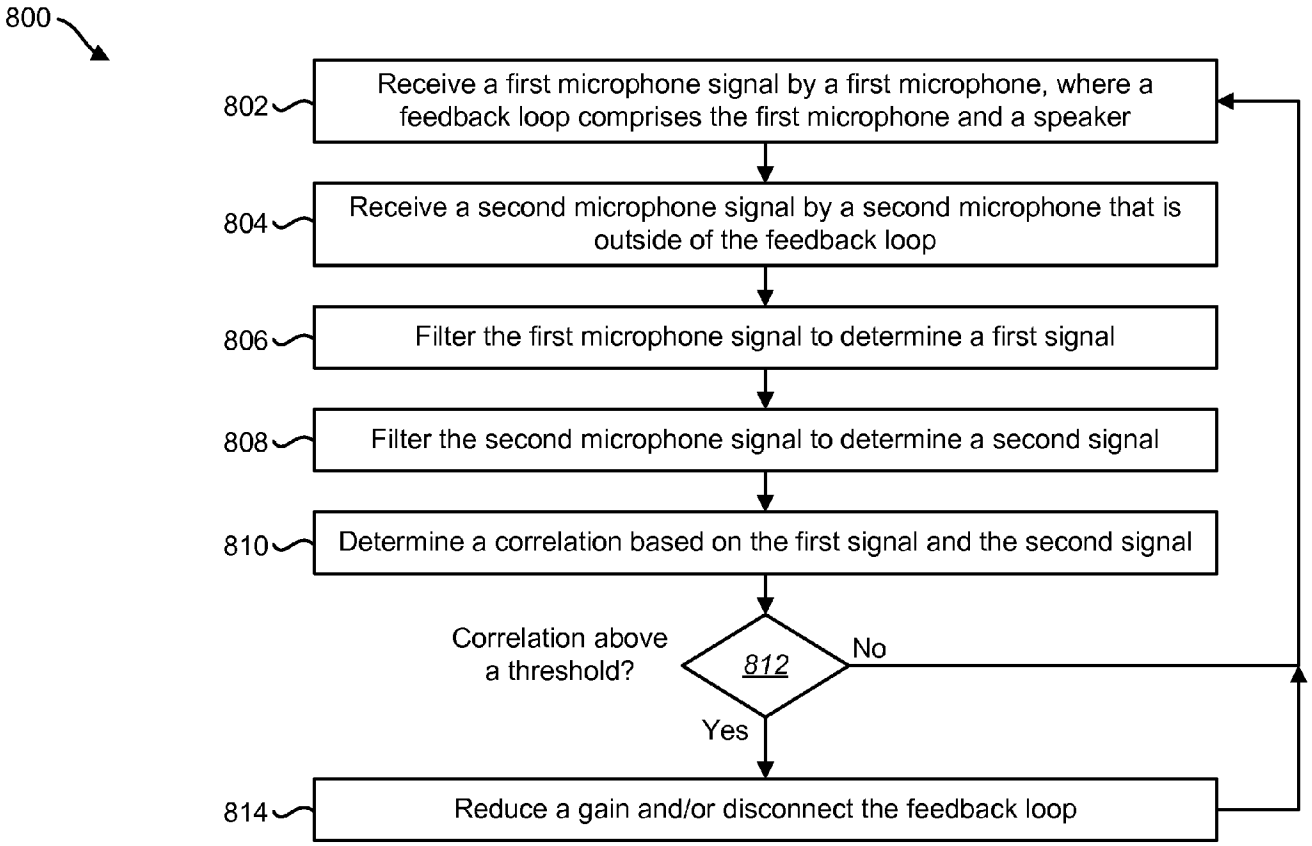
FIG. 8 is a flow diagram illustrating another more specific configuration of a method for feedback detection by an electronic device.

FIG. 8 is a flow diagram illustrating another more specific configuration of a method 800 for feedback detection by an electronic device 710. The electronic device 710 may receive 802 a first microphone signal 724 by one or more first microphones 712. This may be accomplished as described above in connection with one or more of FIGS. 2-7.

The electronic device 710 may receive 804 a second microphone signal 726 by one or more second microphones 722 that are outside the feedback loop. This may be accomplished as described above in connection with one or more of FIGS. 2-7, for example.

The electronic device 710 may filter 806 the first microphone signal 724 to determine a first signal 752. This may be accomplished as described above in connection with one or more of FIGS. 2-7. For example, filtering the first microphone signal 724 may include equalizing the first microphone signal 724 based on the first filter 735 (e.g., calculating SN or convolving their time-domain equivalents). In particular, the first filter 735 may correspond to a non-feedback transfer function.

The electronic device 710 may filter 808 the second microphone signal 726 to determine the second signal 756. This may be accomplished as described above in connection with one or more of FIGS. 2-7. For example, filtering the second microphone signal 726 may include equalizing the second microphone signal 726 based on the second filter 754 (e.g., calculating FE or convolving their time-domain equivalents). In particular, the second filter 754 may correspond to a feedback transfer function.

The electronic device 710 may determine 810 a correlation 748 based on the first microphone signal 724 and the second microphone signal 726. This may be accomplished as described above in connection with one or more of FIGS. 2-7. For example, the electronic device 710 may determine 810 a correlation 748 (e.g., normalized correlation 748) based on a first signal and a second signal. In some configurations, determining 810 a correlation 748 may include calculating Corr(FE, SN), $$\frac{\mathrm{Corr}(FE, SN)}{Std(FE)Std(SN)}$$

or $$\frac{\mathrm{Corr}(FE, SN)}{\mathrm{Var}(FE)}.$$

The electronic device 710 may determine 812 whether the correlation 748 is above a threshold. This may be accomplished as described above in connection with one or more of FIGS. 2-3 and 5-7. For example, the electronic device 710 (e.g., feedback determination module 750) may determine that feedback is occurring when the correlation 748 is above a threshold. In some configurations, the electronic device 710 (e.g., feedback determination module 750) may determine that feedback is not occurring when the correlation is below the same or a different threshold. In some configurations, the electronic device 710 may utilize multiple thresholds as described above. In some configurations, the degree or amount of correlation may be utilized to determine how to adjust processing of the first microphone signal 724.

If the correlation 748 is not above the threshold (e.g., if the correlation 748 is below a lowest threshold, indicating that no feedback is occurring), the electronic device 710 may return to repeat the method 800 or operation may end. If the correlation 748 is above (e.g., greater than or equal to) the threshold, the electronic device 710 may reduce 814 a gain (e.g., loop gain) and/or disconnect 814 the feedback loop. This may be accomplished as described above in connection with one or more of FIGS. 2-3 and 5-7. In some configurations, the electronic device 710 may reduce 814 a gain (to differing degrees, for example) and/or disconnect 814 the feedback loop based on the amount of correlation (e.g., based on an amount of correlation on a scale of multiple thresholds) as described above.

Figure 9:
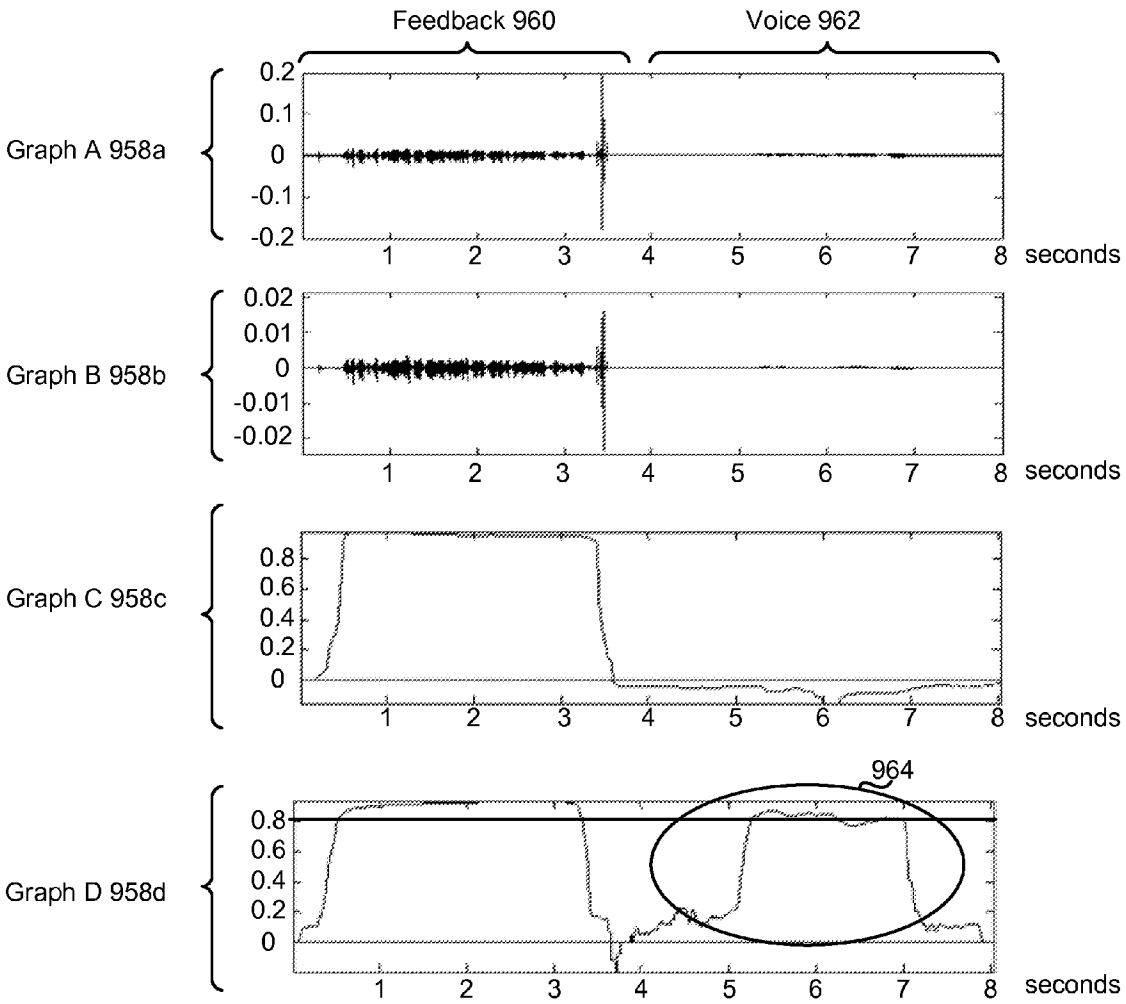
FIG. 9 includes graphs illustrating an example of performance of the systems and methods disclosed herein.

FIG. 9 includes graphs illustrating an example of performance of the systems and methods disclosed herein. In particular, FIG. 9 includes graph A 958*a*, graph B 958*b*, graph C 958*c* and graph D 958*d*. Each of the horizontal axes of the graphs 958*a-d* are illustrated in time (seconds). The vertical axis of graph A 958*a* illustrates the amplitude of a signal. The vertical axis of graph B 958*b* illustrates the amplitude of another signal. The vertical axis of graph C 958*c* illustrates a correlation in accordance with the systems and methods disclosed herein. The vertical axis of graph D 958*d* illustrates a correlation in accordance with a known approach.

Graph A 958*a* illustrates a signal over time. In particular, graph A 958*a* illustrates one example of a filtered first microphone signal (e.g., filtered noise microphone signal), where feedback 960 occurs approximately between 0 and 3.5 seconds and where voice 962 is received approximately between 5 and 7 seconds. More specifically, the waveform depicted in graph A 958*a* may be one example of the first signal 752 (e.g., SN) described above in connection with FIG. 7.

Graph B 958*b* illustrates another signal over time. In particular, graph B 958*b* illustrates one example of a filtered second microphone signal (e.g., filtered error microphone signal), where feedback 960 occurs approximately between 0 and 3.5 seconds and where voice 962 is received approximately between 5 and 7 seconds. More specifically, the waveform depicted in graph B 958*b* may be one example of the second signal 756 (e.g., FE) described above in connection with FIG. 7.

Graph C 958*c* illustrates an example of a correlation $$\left(\text{e.g., } \frac{\text{Corr}(FE, SN)}{Std(FE)Std(SN)}\right)$$

in accordance with the systems and methods disclosed herein. Graph C 958*c* corresponds to graphs A-B 958*a-b*. As illustrated, the correlation that is calculated in accordance with the systems and methods disclosed herein is approximately 1 during feedback 960 and is approximately 0 during voice 962.

Graph D 958*d* illustrates an example of a correlation $$\left(\text{e.g., } \frac{\text{Corr}(N, WFN)}{Std(N)Std(WFN)}\right)$$

in accordance with one known approach. As illustrated, the correlation that is calculated in accordance with the systems and methods disclosed herein is approximately 1 during feedback 960 and is approximately 0.9 and 0.8 during voice 962. This high correlation value during voice 962 is a false positive 964. In particular, the known approach provides a high correlation value during voice that can falsely indicate feedback.

Figure 10:
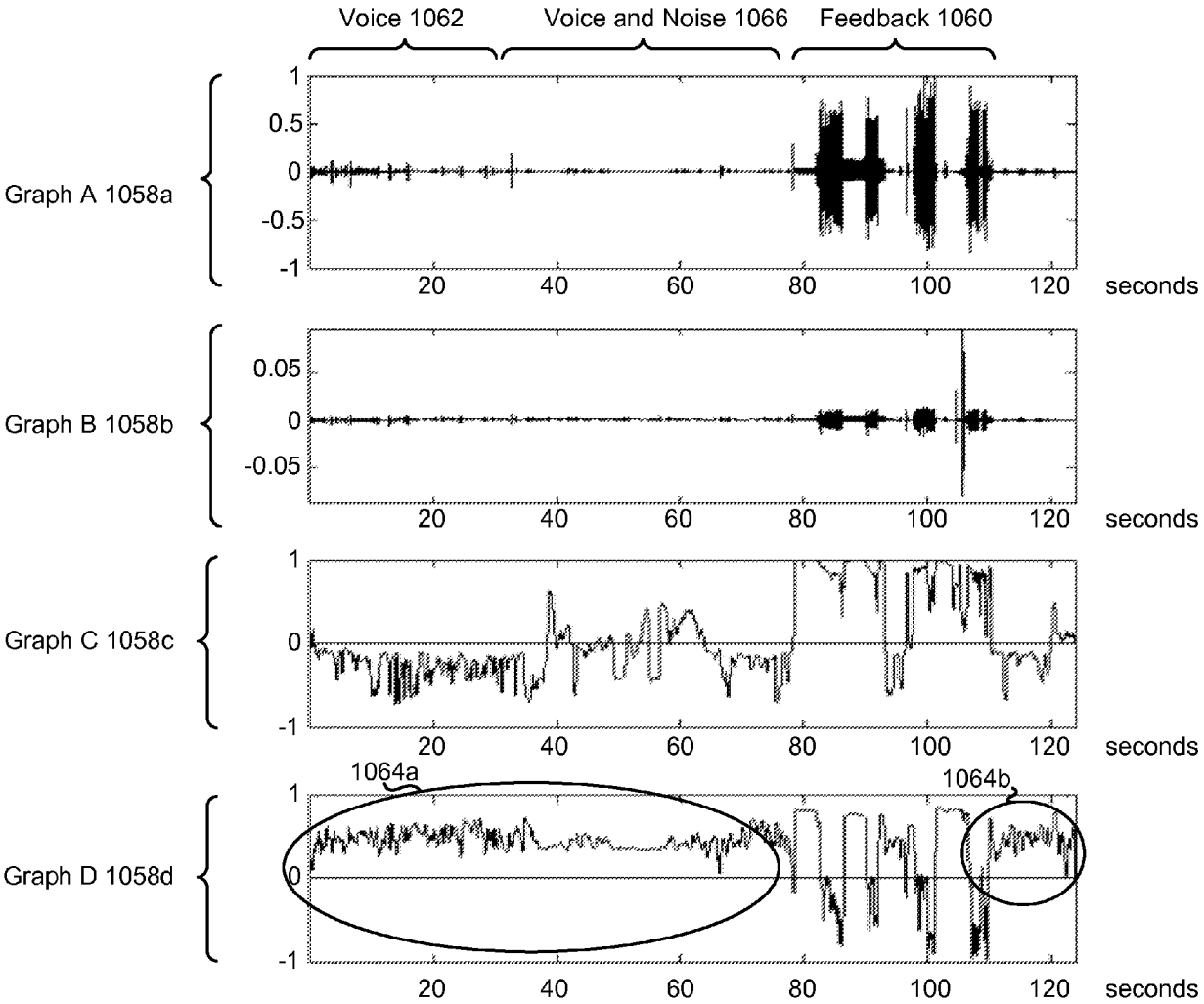
FIG. 10 includes graphs illustrating another example of performance of the systems and methods disclosed herein.

FIG. 10 includes graphs illustrating another example of performance of the systems and methods disclosed herein. In particular, FIG. 10 includes graph A 1058*a*, graph B 1058*b*, graph C 1058*c* and graph D 1058*d*. Each of the horizontal axes of the graphs 1058*a-d* are illustrated in time (seconds). The vertical axis of graph A 1058*a* illustrates the amplitude of a signal. The vertical axis of graph B 1058*b* illustrates the amplitude of another signal. The vertical axis of graph C 1058*c* illustrates a correlation in accordance with the systems and methods disclosed herein. The vertical axis of graph D 1058*d* illustrates a correlation in accordance with a known approach.

Graph A 1058*a* illustrates a signal over time. In particular, graph A 1058*a* illustrates another example of a filtered first microphone signal (e.g., filtered noise microphone signal), where voice 1062 is received approximately between 0 and 33 seconds, where voice and noise 1066 are received approximately between 33 and 77 seconds and where feedback 1060 occurs approximately between 78 and 111 seconds. More specifically, the waveform depicted in graph A 1058*a* may be one example of the first signal 752 (e.g., SN) described above in connection with FIG. 7.

Graph B 1058*b* illustrates another signal over time. In particular, graph B 1058*b* illustrates another example of a filtered second microphone signal (e.g., filtered error microphone signal), where voice 1062 is received approximately between 0 and 33 seconds, where voice and noise 1066 are received approximately between 33 and 77 seconds and where feedback 1060 occurs approximately between 78 and 111 seconds. More specifically, the waveform depicted in graph B 1058*b* may be one example of the second signal 756 (e.g., FE) described above in connection with FIG. 7.

Graph C 1058*c* illustrates an example of a correlation $$\left(\text{e.g., } \text{Corr}(FE, SN), \frac{\text{Corr}(FE, SN)}{Std(FE)Std(SN)} \text{ or } \frac{\text{Corr}(FE, SN)}{\text{Var}(FE)}\right)$$

in accordance with the systems and methods disclosed herein. Graph C 1058*c* corresponds to graphs A-B 1058*a-b*. As illustrated, the correlation that is calculated in accordance with the systems and methods disclosed herein is high during feedback 1060 and lower during voice 1062 and during voice and noise 1066.

Graph D 1058*d* illustrates an example of a correlation $$\left(\text{e.g., } \frac{\text{Corr}(N, WFN)}{Std(N)Std(WFN)}\right)$$

in accordance with one known approach. As illustrated, the correlation that is calculated in accordance with the systems and methods disclosed herein is high during voice 1062 and during voice and noise 1066. The high values during voice 1062 and during voice and noise 1066 is a false positive 1064*a*. Another false positive 1064*b* is also illustrated after the feedback 1060. In particular, the known approach provides a high correlation value during voice 1062 and during voice and noise 1066 that can falsely indicate feedback.

Figure 11:
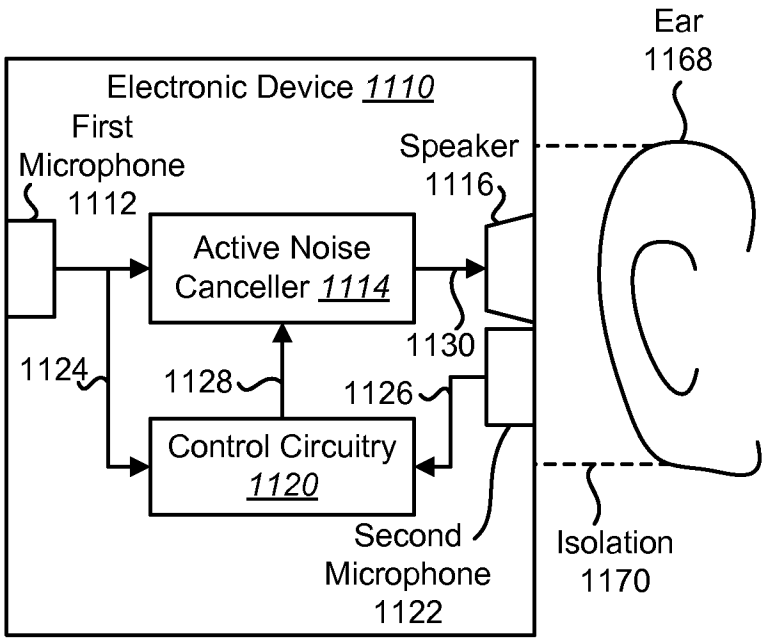
FIG. 11 is a block diagram illustrating another more specific configuration of an electronic device in which systems and methods for feedback detection may be implemented.

FIG. 11 is a block diagram illustrating another more specific configuration of an electronic device 1110 (e.g., a handset ANC application scenario) in which systems and methods for feedback detection may be implemented. The electronic device 1110 may be one example of one or more of the electronic devices 210, 510, 710 described in connection with FIGS. 2, 5 and 7. For instance, the electronic device 1110 may be a handset, such as a smart phone or a cellular phone. The electronic device 1110 includes one or more first microphones 1112 (e.g., noise microphones), an active noise canceller 1114, one or more speakers 1116 (e.g., receivers), control circuitry 1120 and one or more second microphones 1122 (e.g., auxiliary or error microphones). One or more of these components may be examples of corresponding components described in connection with one or more of FIGS. 2, 5 and 7. Additionally, one or more of the components of the electronic device 1110 may operate in accordance with one or more of the functions, procedures and/or examples described in connection with FIGS. 2-8.

In this example, the second microphone(s) 1122 are located near the speaker 1116. One difference between the systems and methods disclosed herein and some known approaches is the utilization of an extra microphone (e.g., the one or more second microphones 1122).

In some configurations, the first microphone(s) 1112 may be located away from the speaker 1116 and/or the second microphone(s) 1122. For example, the first microphone(s) 1112 may be located on the back of the electronic device 1110 (e.g., on the opposite side from the speaker(s) 1116 and/or second microphone(s) 1122. Additionally or alternatively, the first microphone(s) 1112 may be located outside of isolation 1170, while the second microphone(s) 1122 may be typically located inside of isolation 1170.

As described above, the one or more first microphones 1112 may be configured to receive a first microphone signal 1124. The first microphone signal 1124 may be provided to the active noise canceller 1114 and to the control circuitry 1120. The active noise canceller 1114 may generate a processed first microphone signal 1130 that is utilized to create destructive interference and/or reduction of acoustical signals and/or noise captured by the first microphone(s) 1112 (e.g., environmental sounds). The processed first microphone signal 1130 may be provided to the speaker 1116. The speaker 1116 may output an acoustic signal based on the processed first microphone signal 1130, which may travel to the second microphone(s) 1122 and/or may travel (e.g., leak) to the first microphone(s) 1112 when a breakdown in isolation 1170 occurs. The isolation 1170 may be created by a user pressing the electronic device 1110 to his/her ear 1168 or may be created by an ear cup or housing of the electronic device 1110.

The second microphone(s) 1122 may be configured to receive a second microphone signal 1126, which may be provided to the control circuitry 1120. The control circuitry 1120 may filter the first microphone signal 1124, filter the second microphone signal 1126, determine a correlation, determine whether feedback is occurring based on the correlation and/or may adjust processing (via a control signal 1128, for example) as described in connection with one or more of FIGS. 2-8. For example, the control circuitry 1120 may reduce a gain (e.g., loop gain) of the active noise canceller 1114 and/or may disconnect the feedback loop at the active noise canceller 1114 when feedback is occurring.

Figure 12:
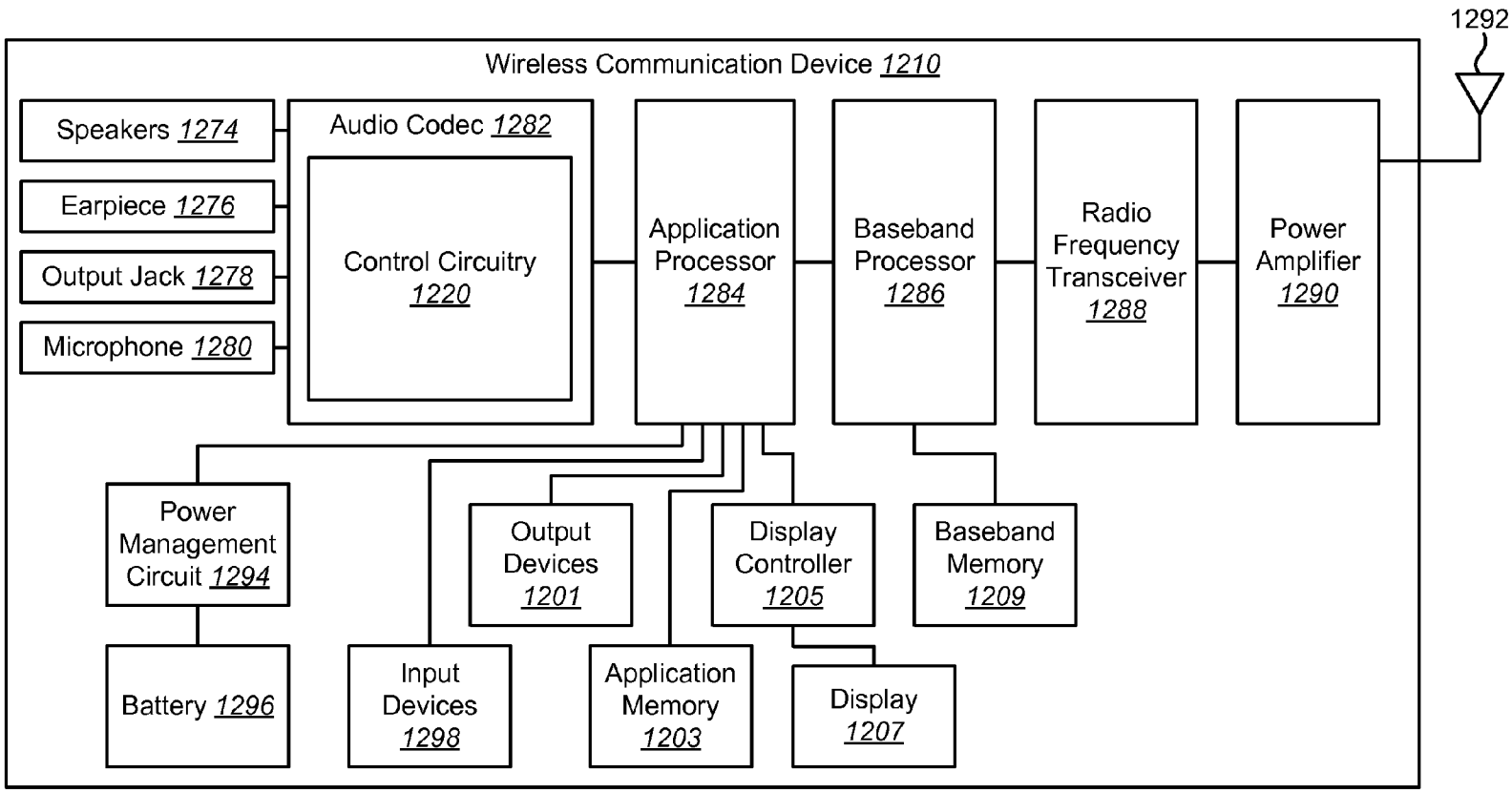
FIG. 12 is a block diagram illustrating one configuration of a wireless communication device in which systems and methods for detecting feedback may be implemented.

FIG. 12 is a block diagram illustrating one configuration of a wireless communication device 1210 in which systems and methods for detecting feedback may be implemented. The wireless communication device 1210 illustrated in FIG. 12 may be an example of one or more of the electronic devices 210, 510, 710, 1110 described herein. The wireless communication device 1210 may include an application processor 1284. The application processor 1284 generally processes instructions (e.g., runs programs) to perform functions on the wireless communication device 1210. The application processor 1284 may be coupled to an audio coder/decoder (codec) 1282.

The audio codec 1282 may be used for coding and/or decoding audio signals. The audio codec 1282 may be coupled to at least one speaker 1274, an earpiece 1276, an output jack 1278 and/or at least one microphone 1280. The speakers 1274 may include one or more electro-acoustic transducers that convert electrical or electronic signals into acoustic signals. For example, the speakers 1274 may be used to play music or output a speakerphone conversation, etc. The earpiece 1276 may be another speaker or electro-acoustic transducer that can be used to output acoustic signals (e.g., speech signals) to a user. For example, the earpiece 1276 may be used such that only a user may reliably hear the acoustic signal. The output jack 1278 may be used for coupling other devices to the wireless communication device 1210 for outputting audio, such as headphones. The speakers 1274, earpiece 1276 and/or output jack 1278 may generally be used for outputting an audio signal from the audio codec 1282. The at least one microphone 1280 may be an acousto-electric transducer that converts an acoustic signal (such as a user's voice) into electrical or electronic signals that are provided to the audio codec 1282.

The audio codec 1282 may include control circuitry 1220. The control circuitry 1220 may be an example of one or more of the control circuitries 220, 520, 720, 1120 described above. In some configurations, the control circuitry 1220 may be implemented on the wireless communication device 1210 separately from the audio codec 1282.

The application processor 1284 may also be coupled to a power management circuit 1294. One example of a power management circuit 1294 is a power management integrated circuit (PMIC), which may be used to manage the electrical power consumption of the wireless communication device 1210. The power management circuit 1294 may be coupled to a battery 1296. The battery 1296 may generally provide electrical power to the wireless communication device 1210. For example, the battery 1296 and/or the power management circuit 1294 may be coupled to at least one of the elements included in the wireless communication device 1210.

The application processor 1284 may be coupled to at least one input device 1298 for receiving input. Examples of input devices 1298 include infrared sensors, image sensors, accelerometers, touch sensors, keypads, etc. The input devices 1298 may allow user interaction with the wireless communication device 1210. The application processor 1284 may also be coupled to one or more output devices 1201. Examples of output devices 1201 include printers, projectors, screens, haptic devices, etc. The output devices 1201 may allow the wireless communication device 1210 to produce output that may be experienced by a user.

The application processor 1284 may be coupled to application memory 1203. The application memory 1203 may be any electronic device that is capable of storing electronic information. Examples of application memory 1203 include double data rate synchronous dynamic random access memory (DDRAM), synchronous dynamic random access memory (SDRAM), flash memory, etc. The application memory 1203 may provide storage for the application processor 1284. For instance, the application memory 1203 may store data and/or instructions for the functioning of programs that are run on the application processor 1284.

The application processor 1284 may be coupled to a display controller 1205, which in turn may be coupled to a display 1207. The display controller 1205 may be a hardware block that is used to generate images on the display 1207. For example, the display controller 1205 may translate instructions and/or data from the application processor 1284 into images that can be presented on the display 1207. Examples of the display 1207 include liquid crystal display (LCD) panels, light emitting diode (LED) panels, cathode ray tube (CRT) displays, plasma displays, etc.

The application processor 1284 may be coupled to a baseband processor 1286. The baseband processor 1286 generally processes communication signals. For example, the baseband processor 1286 may demodulate and/or decode received signals. Additionally or alternatively, the baseband processor 1286 may encode and/or modulate signals in preparation for transmission.

The baseband processor 1286 may be coupled to baseband memory 1209. The baseband memory 1209 may be any electronic device capable of storing electronic information, such as SDRAM, DDRAM, flash memory, etc. The baseband processor 1286 may read information (e.g., instructions and/or data) from and/or write information to the baseband memory 1209. Additionally or alternatively, the baseband processor 1286 may use instructions and/or data stored in the baseband memory 1209 to perform communication operations.

The baseband processor 1286 may be coupled to a radio frequency (RF) transceiver 1288. The RF transceiver 1288 may be coupled to a power amplifier 1290 and one or more antennas 1292. The RF transceiver 1288 may transmit and/or receive radio frequency signals. For example, the RF transceiver 1288 may transmit an RF signal using a power amplifier 1290 and at least one antenna 1292. The RF transceiver 1288 may also receive RF signals using the one or more antennas 1292.

Figure 13:
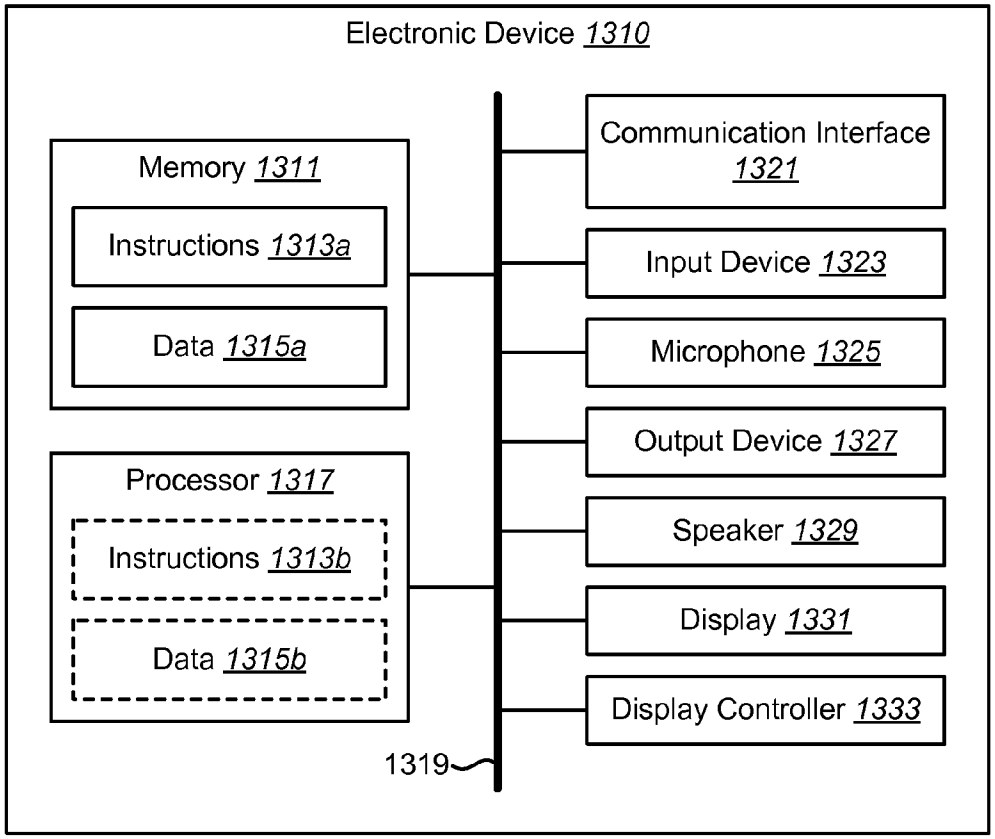
FIG. 13 illustrates various components that may be utilized in an electronic device.

FIG. 13 illustrates various components that may be utilized in an electronic device 1310. The illustrated components may be located within the same physical structure or in separate housings or structures. The electronic device 1310 described in connection with FIG. 13 may be implemented in accordance with one or more of the electronic devices 210, 510, 710, 1110 and wireless communication device 1210 described herein. The electronic device 1310 includes a processor 1317. The processor 1317 may be a general purpose single- or multi-chip microprocessor (e.g., an ARM), a special purpose microprocessor (e.g., a digital signal processor (DSP)), a microcontroller, a programmable gate array, etc. The processor 1317 may be referred to as a central processing unit (CPU). Although just a single processor 1317 is shown in the electronic device 1310 of FIG. 13, in an alternative configuration, a combination of processors (e.g., an ARM and DSP) could be used.

The electronic device 1310 also includes memory 1311 in electronic communication with the processor 1317. That is, the processor 1317 can read information from and/or write information to the memory 1311. The memory 1311 may be any electronic component capable of storing electronic information. The memory 1311 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1315*a* and instructions 1313*a* may be stored in the memory 1311. The instructions 1313*a* may include one or more programs, routines, sub-routines, functions, procedures, etc. The instructions 1313*a* may include a single computer-readable statement or many computer-readable statements. The instructions 1313*a* may be executable by the processor 1317 to implement one or more of the methods, functions and procedures described above. Executing the instructions 1313*a* may involve the use of the data 1315*a* that is stored in the memory 1311. FIG. 13 shows some instructions 1313*b* and data 1315*b* being loaded into the processor 1317 (which may come from instructions 1313*a* and data 1315*a*).

The electronic device 1310 may also include one or more communication interfaces 1321 for communicating with other electronic devices. The communication interfaces 1321 may be based on wired communication technology, wireless communication technology, or both. Examples of different types of communication interfaces 1321 include a serial port, a parallel port, a Universal Serial Bus (USB), an Ethernet adapter, an Institute of Electrical and Electronics Engineers (IEEE) 1394 bus interface, a small computer system interface (SCSI) bus interface, an infrared (IR) communication port, a Bluetooth wireless communication adapter, a 3rd Generation Partnership Project (3GPP) transceiver, an IEEE 802.11 ("Wi-Fi") transceiver and so forth. For example, the communication interface 1321 may be coupled to one or more antennas (not shown) for transmitting and receiving wireless signals.

The electronic device 1310 may also include one or more input devices 1323 and one or more output devices 1327. Examples of different kinds of input devices 1323 include a keyboard, mouse, microphone, remote control device, button, joystick, trackball, touchpad, lightpen, etc. For instance, the electronic device 1310 may include one or more microphones 1325 for capturing acoustic signals. In one configuration, a microphone 1325 may be a transducer that converts acoustic signals (e.g., voice, speech) into electrical or electronic signals. Examples of different kinds of output devices 1327 include a speaker, printer, etc. For instance, the electronic device 1310 may include one or more speakers 1329. In one configuration, a speaker 1329 may be a transducer that converts electrical or electronic signals into acoustic signals. One specific type of output device which may be typically included in an electronic device 1310 is a display device 1331. Display devices 1331 used with configurations disclosed herein may utilize any suitable image projection technology, such as a cathode ray tube (CRT), liquid crystal display (LCD), light-emitting diode (LED), gas plasma, electroluminescence, or the like. A display controller 1333 may also be provided, for converting data stored in the memory 1311 into text, graphics, and/or moving images (as appropriate) shown on the display device 1331.

The various components of the electronic device 1310 may be coupled together by one or more buses, which may include a power bus, a control signal bus, a status signal bus, a data bus, etc. For simplicity, the various buses are illustrated in FIG. 13 as a bus system 1319. It should be noted that FIG. 13 illustrates only one possible configuration of an electronic device 1310. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, etc., described in connection with any one of the configurations described herein may be combined with one or more of the functions, procedures, components, elements, structures, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise Random-Access Memory (RAM), Read-Only Memory (ROM), Electrically Erasable Programmable Read-Only Memory (EEPROM), flash memory, Compact Disc Read-Only Memory (CD-ROM) or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for feedback detection by an electronic device, comprising:

receiving a first microphone signal by a first microphone, wherein a feedback loop comprises the first microphone and a speaker;

receiving a second microphone signal by a second microphone that is outside of the feedback loop;

filtering the first microphone signal using a first filter to determine a first signal, wherein the first filter corresponds to a non-feedback transfer function from a processed first microphone signal to the second microphone that includes the speaker;

filtering the second microphone signal using a second filter to determine a second signal, wherein the second filter corresponds to a feedback transfer function from the processed first microphone signal to the first microphone that does not include the speaker;

determining a correlation between the first signal from a feedback path and the second signal from a non-feedback path, wherein the first signal and the second signal exhibit a higher correlation in the presence of feedback from the speaker to the first microphone and exhibit a lower correlation in absence of the feedback from the speaker to the first microphone; and determining whether the feedback from the speaker to the first microphone is occurring based on the correlation.

2. The method of claim 1, wherein determining whether feedback is occurring comprises determining that feedback is occurring when the correlation is above a threshold.

3. The method of claim 1, wherein determining whether feedback is occurring comprises determining that feedback is not occurring when the correlation is below a threshold.

4. The method of claim 1, further comprising adjusting processing of the first microphone signal when feedback is occurring.

5. The method of claim 4, wherein adjusting processing comprises at least one of reducing a gain and disconnecting the feedback loop.

6. The method of claim 1, wherein filtering the first microphone signal comprises equalizing the first microphone signal based on the first filter, and wherein filtering the second microphone signal comprises equalizing the second microphone signal based on the second filter.

7. The method of claim 1, wherein the second microphone is located near the speaker.

8. The method of claim 1, wherein determining whether feedback is occurring avoids detecting non-feedback sound as feedback.

9. An electronic device for feedback detection, comprising:

a first microphone configured to receive a first microphone signal;

a speaker coupled to the first microphone, wherein a feedback loop comprises the first microphone and the speaker;

a second microphone configured to receive a second microphone signal; and control circuitry coupled to the first microphone and to the second microphone, wherein the control circuitry is configured to:

filter the first microphone signal using a first filter to determine a first signal, wherein the first filter corresponds to a non-feedback transfer function from a processed first microphone signal to the second microphone that includes the speaker, filter the second microphone signal using a second filter to determine a second signal, wherein the second filter corresponds to a feedback transfer function from the processed first microphone signal to the first microphone that does not include the speaker, determine a correlation between the first signal from a feedback path and the second signal from a non-feedback path, wherein the first signal and the second signal exhibit a higher correlation in the presence of feedback from the speaker to the first microphone and exhibit a lower correlation in absence of the feedback from the speaker to the first microphone;

determine whether the feedback from the speaker to the first microphone is occurring based on the correlation.

10. The electronic device of claim 9, wherein determining whether feedback is occurring comprises determining that feedback is occurring when the correlation is above a threshold.

11. The electronic device of claim 9, wherein determining whether feedback is occurring comprises determining that feedback is not occurring when the correlation is below a threshold.

12. The electronic device of claim 9, wherein the control circuitry further adjusts processing of the first microphone signal when feedback is occurring.

13. The electronic device of claim 12, wherein adjusting processing comprises at least one of reducing a gain and disconnecting the feedback loop.

14. The electronic device of claim 9, wherein filtering the first microphone signal comprises equalizing the first microphone signal based on the first filter, and wherein filtering the second microphone signal comprises equalizing the second microphone signal based on the second filter.

15. The electronic device of claim 9, wherein the second microphone is located near the speaker.

16. The electronic device of claim 9, wherein determining whether feedback is occurring avoids detecting non-feedback sound as feedback.

17. A computer-program product for feedback detection, comprising a non-transitory tangible computer-readable medium having instructions thereon, the instructions comprising:

code for causing an electronic device to receive a first microphone signal by a first microphone, wherein a feedback loop comprises the first microphone and a speaker;

code for causing the electronic device to receive a second microphone signal by a second microphone that is outside of the feedback loop;

code for causing the electronic device to filter the first microphone signal using a first filter to determine a first signal, wherein the first filter corresponds to a non-feedback transfer function from a processed first microphone signal to the second microphone that includes the speaker;

code for causing the electronic device to filter the second microphone signal using a second filter to determine a second signal, wherein the second filter corresponds to a feedback transfer function from the processed first microphone signal to the first microphone that does not include the speaker;

code for causing the electronic device to determine a correlation between the first signal from a feedback path and the second signal from a non-feedback path, wherein the first signal and the second signal exhibit a higher correlation in the presence of feedback from the speaker to the first microphone and exhibit a lower correlation in absence of the feedback from the speaker to the first microphone; and code for causing the electronic device to determine whether the feedback from the speaker to the first microphone is occurring based on the correlation.

18. The computer-program product of claim 17, wherein determining whether feedback is occurring comprises determining that feedback is occurring when the correlation is above a threshold.

19. The computer-program product of claim 17, further comprising adjusting processing of the first microphone signal when feedback is occurring.

20. The computer-program product of claim 17, wherein the second microphone is located near the speaker.

21. An apparatus for feedback detection, comprising:

a first means for receiving a first input signal, wherein a feedback loop comprises the first means for receiving and a speaker;

a second means for receiving a second input signal, wherein the second means for receiving is outside of the feedback loop;

means for filtering the first microphone signal to determine a first signal, wherein the means for filtering the first microphone signal corresponds to a non-feedback transfer function from a processed first microphone signal to the second microphone that includes the speaker;

means for filtering the second microphone signal to determine a second signal, wherein the means for filtering the second microphone signal corresponds to a feedback transfer function from the processed first microphone signal to the first microphone that does not include the speaker;

means for determining a correlation between the first signal from a feedback path and the second signal from a non-feedback path, wherein the first signal and the second signal exhibit a higher correlation in the presence of feedback from the speaker to the first microphone and exhibit a lower correlation in absence of the feedback from the speaker to the first microphone; and means for determining whether feedback is occurring based on the correlation.

22. The apparatus of claim 21, wherein determining whether feedback is occurring comprises determining that feedback is occurring when the correlation is above a threshold.

23. The apparatus of claim 21, further comprising means for adjusting processing of the first input signal when feedback is occurring.

24. The apparatus of claim 21, wherein the second means for receiving is located near the speaker.

* * * * *